US007218879B2

(12) United States Patent
Enoki et al.

(10) Patent No.: US 7,218,879 B2
(45) Date of Patent: May 15, 2007

(54) IMAGE FORMING APPARATUS CONTROLLING POLARITY OF RESIDUAL TONER AND PROCESS CARTRIDGE FOR USE IN THE SAME

(75) Inventors: Shigekazu Enoki, Kanagawa (JP); Koji Suzuki, Kanagawa (JP); Yasushi Koichi, Kanagawa (JP); Osamu Ariizumi, Kanagawa (JP); Kumiko Hatakeyama, Kanagawa (JP); Koichi Kato, Kanagawa (JP); Masahide Yamashita, Tokyo (JP); Toshiyuki Kabata, Kanagawa (JP); Jun Yura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 68 days.

(21) Appl. No.: 11/002,208

(22) Filed: Dec. 3, 2004

(65) Prior Publication Data

US 2005/0141917 A1 Jun. 30, 2005

(30) Foreign Application Priority Data

Dec. 5, 2003 (JP) ..... 2003-407969
Jun. 2, 2004 (JP) ..... 2004-164476

(51) Int. Cl.
*G03G 21/00* (2006.01)

(52) U.S. Cl. ..... 399/129; 399/127; 399/128; 399/176; 399/148

(58) Field of Classification Search ..... 399/129, 399/128, 127
See application file for complete search history.

(56) References Cited

U.S. PATENT DOCUMENTS 4,885,612 A 12/1989 Satoh et al.

(Continued)

FOREIGN PATENT DOCUMENTS

JP 06-043789 2/1994

(Continued)

OTHER PUBLICATIONS

U.S. Appl. No. 11/002,208, filed Dec. 3, 2004, Enoki et al.

(Continued)

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

An image forming apparatus includes an image carrier, a charging device configured to uniformly charge a surface of the image carrier with a charging member applied with a bias of a first polarity (e.g. a negative polarity) for charging. A latent image forming device forms a latent image on the surface of the image carrier uniformly charged. A developing device develops a latent image by depositing toner grains of the first polarity on the latent image to thereby form a corresponding toner image. A transferring device forms an electric field between the image carrier and a moving member that serves as a movable contact with the image carrier to thereby transfer the toner image from the surface of the image carrier to the moving member or to a recording member nipped between the image carrier and the moving member. A polarity controlling device sets residual toner to a second polarity (e.g. a positive polarity) opposite to the first polarity, before the residual toner left on the image carrier by the transferring device is conveyed to a corresponding position to the charging member.

14 Claims, 8 Drawing Sheets

U.S. PATENT DOCUMENTS

| | | | | |
|---|---|---|---|---|
| 5,321,471 | A * | 6/1994 | Ito et al. | 399/129 |
| 5,400,127 | A | 3/1995 | Arai et al. | |
| 5,621,509 | A * | 4/1997 | Karashima et al. | 399/46 |
| 5,895,146 | A * | 4/1999 | Waki et al. | 399/170 |
| 5,943,533 | A * | 8/1999 | Ogata et al. | 399/129 |
| 6,112,046 | A | 8/2000 | Suzuki et al. | |
| 6,144,824 | A * | 11/2000 | Hashimoto et al. | 399/128 |
| 6,233,416 | B1 * | 5/2001 | Kinosita et al. | 399/128 |
| 6,442,362 | B2 * | 8/2002 | Hirabayashi et al. | 399/129 |
| 2002/0106574 | A1 * | 8/2002 | Haneda et al. | 430/124 |
| 2002/0191985 | A1 * | 12/2002 | Komiya et al. | 399/149 |
| 2003/0077088 | A1 * | 4/2003 | Adachi et al. | 399/129 |
| 2003/0134220 | A1 * | 7/2003 | Emoto et al. | 430/109.4 |

FOREIGN PATENT DOCUMENTS

| | | |
|---|---|---|
| JP | 10-213945 | 8/1998 |
| JP | 2000-181200 | 6/2000 |
| JP | 2001-215799 | 8/2001 |

OTHER PUBLICATIONS

U.S. Appl. No. 11/105,405, filed Apr. 14, 2005, Kabata et al.

* cited by examiner

IMAGE FORMING APPARATUS CONTROLLING POLARITY OF RESIDUAL TONER AND PROCESS CARTRIDGE FOR USE IN THE SAME

BACKGROUND OF THE INVENTION

1. Field of the Invention

The present invention relates to a copier, printer, facsimile apparatus, or similar image forming apparatus, and more specifically to an image forming apparatus with an improved cleaning operation and mechanism.

2. Description of the Background Art

An image forming apparatus of the type using an electrostatic image transfer system is known and is configured to form an electric field between a photoconductive drum or similar image carrier and an intermediate image transfer body, sheet conveyor, or similar moving member for thereby transferring a toner image formed on the image carrier. In that type of image forming apparatus, some residual toner is left on the image carrier after the transfer of the toner image to a subject body, e.g., after transfer to the intermediate image transfer body or to a sheet or recording member. If part of the image carrier on which such residual toner is present is subject to the next image formation, then irregular charging or similar defective charging can occur on the noted part of the image carrier, which lowers image quality. It is a common practice to remove the residual toner from the image carrier with a cleaning device. The problem with such a cleaning device is that it needs an extra space for accommodating a waste toner tank configured to store the residual toner collected from the image carrier and a recycling path along which the residual toner is conveyed to be reused, making the entire apparatus bulky. Particularly, a current trend in the imaging art is toward a tandem image forming apparatus that assigns a particular image carrier to each color to meet the increasing demand for high-speed color image formation. If a cleaning device is utilized in this kind of image forming apparatus, then a particular cleaning device must be assigned to each of a plurality of image carriers, making the above problem more serious.

To solve the problem stated above, Japanese Patent No. 3,091,323 discloses an image forming apparatus using a simultaneous developing and cleaning system that causes a developing device to also collect residual toner. More specifically, the developing device, first used to develop a latent image, is also used as a cleaning device at the same time, so that a particular cleaning device does not have to be assigned to each image carrier. This contributes a great deal to the size reduction of the apparatus.

Also, the image forming apparatus disclosed in Japanese Laid-open publication No. 2000-181200 includes a toner removing structure to remove toner from charging device after the charging device charges an image carrier. The charging device deposits polarity control grains, by which the polarity of toner grains is changed to a same polarity as the image carrier. According to this publication, residual toner having an opposite polarity is electrically deposited on the charging device. Then, the polarity of the residual toner having opposite polarity is changed to the regular polarity by contacting with the charging device. Changing a polarity of the residual toner is effectively performed at a contact portion between the charging device and the toner removing structure. The residual toner changed to the regular polarity is then removed at the contact portion, so that the residual toner is returned to the image carrier. Meanwhile, the residual toner not removed is conveyed to a charging area of the charging device, and then is electrically discharged to the image carrier, by using the difference of electrical potential between the charging device and the image carrier.

Further, the image forming apparatus disclosed in Japanese Laid-open publication No. 2001-215799 includes a toner electrical potential controlling device, which slides in a direction of an image carrier axis, mounted on an upper area from a charging device in a direction of movement of the image carrier.

Also, in the image forming apparatus disclosed in Japanese Laid-open publication No. 10-213945, a different linear velocity is utilized between an image carrier and a charging device.

SUMMARY OF THE INVENTION

It is an object of the present invention to provide an image forming apparatus with an improved cleaning operation and mechanism capable of preventing lowering image quality, and a process cartridge for use in the same.

It is a further object of the present invention to provide a small size, low cost, high image quality, image forming apparatus with an improved cleaning operation and mechanism capable of preventing residual toner passing a position where the image carrier and the charging member contact each other, and a process cartridge for use in the same.

It is a further object of the present invention to provide an image forming apparatus capable of sufficiently reducing filming, making the most of the merits of a bladeless type of cleaning system, and a process cartridge for use in the same.

A novel image forming apparatus of the present invention includes an image carrier. A charging device uniformly charges the surface of the image carrier with a charging member, which is applied with a bias of a first polarity, contacting or adjoining the surface. An electrical static image forming device forms a latent image on the surface of the image carrier thus uniformly charged. A developing device develops the latent image by depositing toner of the first polarity (e.g. a negative polarity) on the latent image to thereby form a corresponding toner image. An image-transferring device forms an electric field between the image carrier and a moving member whose surface is movable in contact with the image carrier to thereby transfer the toner image from the surface of the image carrier to the moving member or to a recording member nipped between the image carrier and the moving member. A polarity-controlling device changes the polarity of the residual toner to an opposite second polarity (e.g. a positive polarity). Then, a charging element temporarily holds the residual toner of the second polarity changed by the polarity-controlling device, and discharges the residual toner to the image carrier at a preferable time. A collecting device collects the residual toner from the image carrier.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

Preferred embodiments of the present invention will be described hereinafter.

Figure 2:
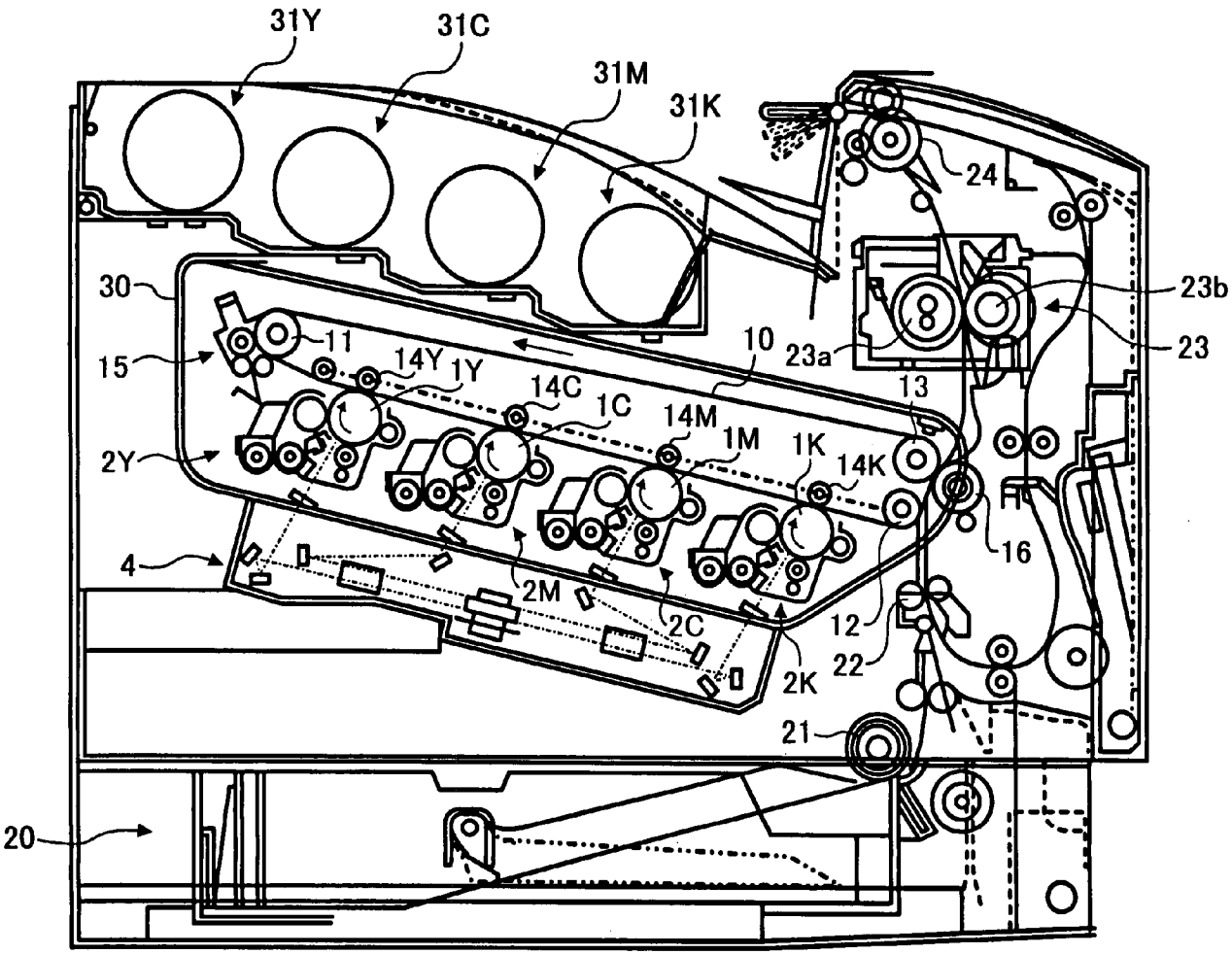
FIG. 2 is a sectional view showing the first embodiment of the image forming apparatus.

Referring to FIG. 2, an image forming apparatus embodying the present invention is shown and implemented as an electrophotographic printer as an example. The printer can form a color image by using 4 colored toners, for example yellow (hereinafter indicated by "Y"), cyan (hereinafter indicated by "C"), magenta (hereinafter indicated by "M"), and black (hereinafter indicated by "K").

As shown, the printer includes four photoconductive drums or image carriers 1Y, 1C, 1M, and 1K, which may be replaced with photoconductive belts, if desired. Each drum 1Y through 1K is made up of a conductive base and can be negatively charged. The photoconductive drums each are rotatably driven in contact with the inner surface of an intermediate transfer belt 10, which forms a loop. Each drum 1Y–1K may include a photoconductive layer formed on the base, and a protection layer formed on the photoconductive layer. In the first embodiment, for each drum 1Y–1K the outside diameter may be 30 mm and the inside diameter may be 28.5 mm.

In the first embodiment, the photoconductive layer may be implemented by an OPC (Organic Photoconductor) to reduce cost, enhance free design, and obviate environmental pollution. Polyvinyl carbozole or a similar photoconductive resin is a typical OPC. Further, OPCs are generally classified into PVK-TNF (2,4,7-trinitrofluorenone) and other charge transfer complex types of OPCs, phthalocyanine binder and other pigment dispersion types of OPCs, and split-function types of OPCs each including a charge generating substrate and a charge transporting substance. Among them, split-function types of OPCs are attracting increasing attention today.

The problem with an OPC is that it lacks mechanical and chemical durability. More specifically, while many charge transporting substances are developed as low molecular weight compounds, the compounds each are usually dispersed in or mixed with an inactive polymer because it cannot form a film alone. Generally, a low molecular weight compound or charge transporting substance and a charge transporting layer, which is implemented by an inactive polymer, are soft and lack mechanical durability. Therefore, when the drums 1Y–1K having a charge transporting layer are repeatedly used, the layer is easily shaved by a charging roller 3*a* (see FIG. 3), which is implemented in a charging device 3, a developer 5, an intermediate transfer belt 10, and a polarity controlling roller 41, which is implemented in a toner polarity controlling device 40. It is therefore preferable to form the protection layer to extend the life of the drums 1Y–1K.

Figure 3:
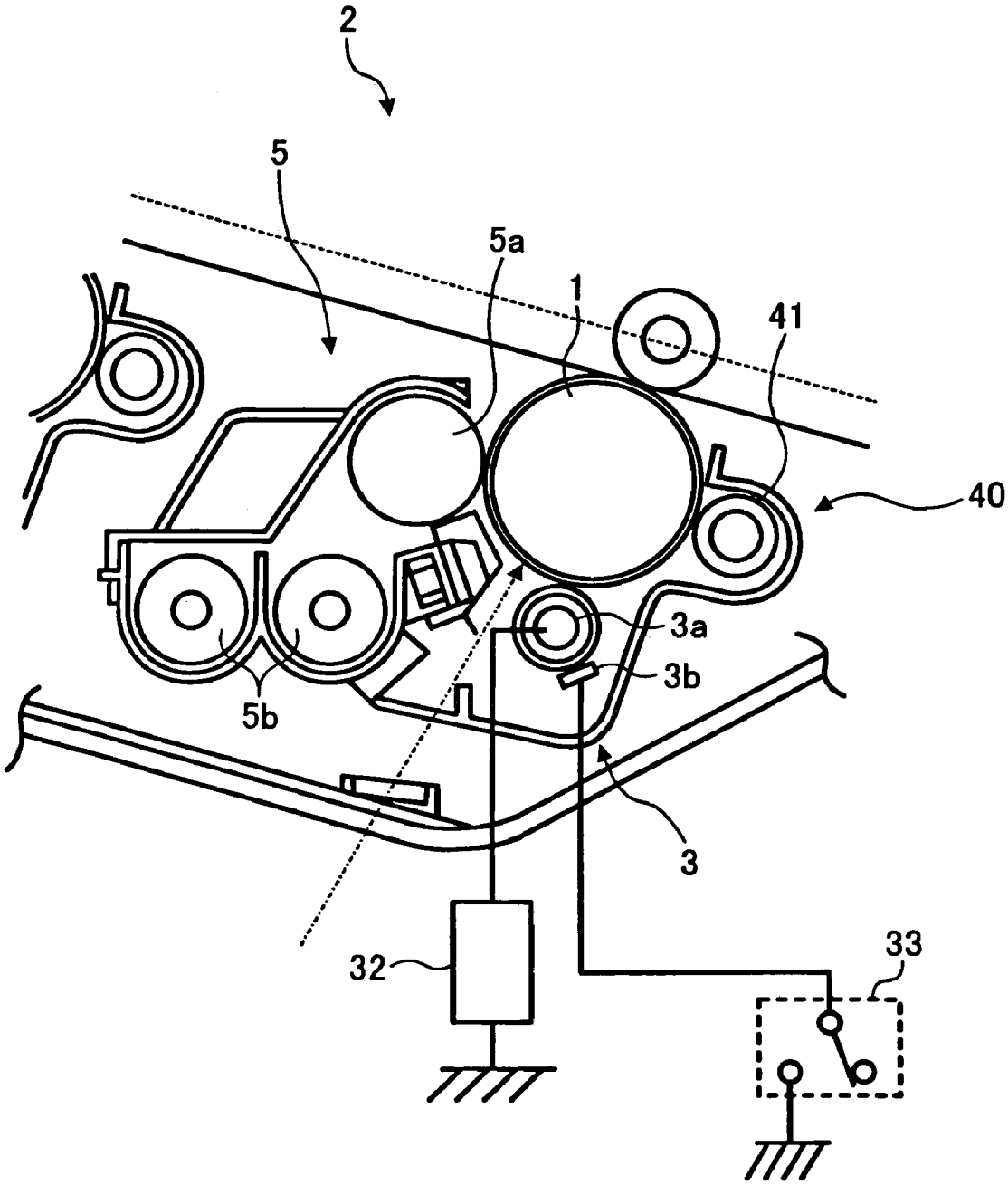
FIG. 3 is a sectional view showing a configuration of a photoconductive drum or image carrier included in the first embodiment.

FIG. 3 is a sectional drawing of the area around drums 1Y, 1C, 1M, and 1K. Since the structures around each drum are substantially the same, only one drum is shown as representative of all the drums 1Y–1K and the symbols indicating a color Y, C, M, and K are omitted. Around the drum 1, a polarity controlling device 40, a charging device 3, and a developing device 5 are arranged along the moving direction of the drum surface. A space is provided between the charging device 3 and the developing device 5 through which light beams generated by an exposing device 4 impinge on the drum 1.

The charging device 3 charges the surface of the drum 1 to, e.g., a negative polarity. In the first embodiment, the charging device 3 includes a charging bias power supply 32 and a charging roller 3*a* or charging member that performs contact or vicinity type of charging. More specifically, the charging roller 3*a* contacts or adjoins the surface of the drum 1 and is applied with a negative bias for uniformly charging the drum 1. In the first embodiment, a DC bias can be applied to the drum 1 such that the surface of the drum 1 is uniformly charged to −500 V. The DC bias may be replaced with an AC-biased DC bias, if desired, in which case an AC bias power supply is additionally needed. In the first embodiment, the charging device 3 includes a bias applying blade 3*b* as an electrical charging device contacting the surface of the charging roller 3*a*. Further, the electrical potential of the surface of the charging roller 3*a* is controlled to be made uniform by the bias applying blade 3*b*.

It is preferable that the edge portion of the charging roller 3*a* contains a thin film around it so that the charging roller 3*a* faces the surface of drum 1 and the thin film of the charging roller 3*a* contacts the surface of drum 1. In such an embodiment, the surface of the charging roller 3*a* and that of the drum 1 are spaced apart only by a thickness of the thin film so that the charging roller 3*a* is located very close to the drum 1. Therefore, an electrical discharge is generated between the surface of the charging roller 3*a* and that of the drum 1 when the charging roller 3*a* is applied with a charging bias.

In FIG. 2, an exposing device 4 generates light beams corresponding to each color image, to impinge on the drum 1 so that a latent image is formed on the surface of drum 1. In the first embodiment, the exposing device 4 can use a laser beam device. However, other exposing devices, e.g. a device using an LED array and a focusing device, are also applicable.

In FIG. 3, the developing device 5 includes a developing roller 5*a* as a developer bearing device, and a case mounting the developing roller 5*a* to be partly exposed. In the first embodiment, the developing device 5 uses two component developer of a toner and magnetic carrier, but is applicable using single component developer without magnetic carrier. The developing device 5 can include internal toner of a color corresponding to each developing device, which is supplied from a toner bottle 31Y, 31C, 31M, and 31K (FIG. 2). Each toner bottle is detachably mounted in the printer to be exchanged with a new bottle separately. In such an embodiment, the printer can be continuously used if a toner bottle is exchanged with a new one, when the toner bottle is empty and the printer indicates a toner end. Therefore, other components having a longer life can still be used so that a cost for maintenance is lessened.

The toner supplied from a respective toner bottle 31Y, 31C, 31M, 31K to the respective developing device 5 is agitated and conveyed with the magnetic carriers by an agitating and conveying screw 5*b* and then is deposited on the developing roller 5*a*. The developing roller 5*a* includes a magnet roller as a magnetic force generating device and a developing sleeve rotating around the magnet roller along a same axis. When developed, the magnetic carrier forms a magnetic brush around the developing roller 5*a* by the magnetic force generated by the magnet roller, and then is conveyed to a corresponding area to the drum 1, which will be developed. In such a condition, the surface of developing roller 5*a* linearly moves faster than that of drum 1. Then, the magnetic carrier forming the magnetic brush around the developing roller 5*a* contacts the surface of the drum 1, and the toner attached to the surface of carrier 5*a* is developed on the surface of drum 1. When developed, the developing roller 5*a* is applied, e.g., a −300 V of developing bias from a power source, and then an electric field for developing is formed in the developing area of the drum 1. Then, an electrostatic force works the toner on the developing roller 5*a* toward the latent image between the latent image of the drum 1 and the developing roller 5*a*. That causes the toner on the developing roller 5*a* to be deposited on the latent image. As a result, the latent image on each drum 1 is developed corresponding to each color. In this first embodiment, the developing roller 5*a* can be connected with a clutch mechanism; therefore the rotation of the developing roller 5*a* can be stopped if the clutch is activated.

In the first embodiment, the intermediate transfer belt 10 as a moving member is tensioned by three supporting rollers 11, 12, and 13, and can be rotated in contact with the drums 1Y, 1C, 1M, and 1K in the direction shown in FIG. 2. The image on each drum 1Y, 1C, 1M, and 1K is transferred onto the intermediate transfer belt 10 so that each image is overlapped. It is preferable that a transferring charger as a transferring mechanism is used. However, in the first embodiment, a transferring roller is preferable because less transferring dust is generated. Concretely, preliminary transferring rollers 14Y, 14C, 14M, and 14*k* as transferring devices are mounted behind the intermediate transferring belt 10 corresponding to each drum 1Y, 1C, 1M, and 1K. In the first embodiment, the intermediate transfer belt 10 is pushed by each preliminary transferring roller 14Y, 14C, 14M, and 14K, and a nip part for preliminary transferring is formed between a part of the intermediate transfer belt 10 and each drum 1Y, 1C, 1M, and 1K. Then, when the image is transferred onto the intermediate transfer belt 10 from each drum 1Y, 1C, 1M, and 1K, a positive bias is applied to each preliminary transferring roller 14Y, 14C, 14M, and 14K. Therefore, an electric field for transferring is formed at each preliminary transferring nip part, and then the image on each drum 1Y, 1C, 1M, and 1K is electrically attached and is transferred.

Around the intermediate transfer belt 10, a belt-cleaning device 15 is mounted to remove residual toner from its surface. In this first embodiment, the belt-cleaning device 15 includes a fur brush and cleaning blade to remove residual toner from the intermediate transfer belt 10 and to collect the removed residual toner. The residual toner collected is conveyed to a residual toner bottle by a transferring mechanism.

In a part of the intermediate transfer belt 10 tensioned by the supporting roller 13, a secondary transferring roller 16 is mounted and contacts part of the intermediate transfer belt 10. A nip is formed between the intermediate transfer belt 10 and the secondary transferring roller 16. Papers as a recording member can be transferred to the nip when a paper is to be printed. The paper is stacked in a cassette 20 mounted below the exposing device 4 as shown in FIG. 2, and is transferred to the nip formed by the secondary transferring mechanism by a paper-transferring roller 21, registration rollers 22, and the like. Then, the overlapped image formed on the intermediate transfer belt 10 is collectively transferred to the paper at the nip formed by the secondary transferring roller 16. In the condition of the secondary transferring, the secondary transferring roller 16 is applied a positive bias so that the electric field for transferring can transfer the image on the intermediate transfer belt 10 onto the paper.

Downstream of the nip of the secondary transferring roller 16, a heat-fixing device 23 as a fixing device is mounted. The heat-fixing device 23 includes a heating roller 23*a* and a pressing roller 23*b*. The heat and pressing rollers press a paper after passing from the nip of the secondary transferring roller 16. Then, a toner on the paper is melted so that the image is fixed on the paper. After fixing, the paper is discharged by a discharging roller 24 to a discharging tray on an upper surface of the apparatus.

In the first embodiment, a photoconductive drum 1Y, 1C, 1M, and 1K, a developing device 5 mounted around the photoconductive drum, the exposing device 4, the intermediate belt 10, and the belt cleaning device 15 are collectively mounted as a process cartridge 30. The process cartridge 30 is detachably mounted on the printer body. Therefore, in the case that the parts mounted in the process cartridge 30 reach their end life, or need any maintenance, the process cartridge 30 itself is only exchanged with a new one if maintenance is needed. In the first embodiment, the toner bottles 31Y, 31C, 31M, and 31K are detachable from the printer body separately from the process cartridge 30.

It is preferable that the process cartridge 30 including the photoconductive drum 1 and one of the charging device 3 and the developing device 5 mounted around the drum 1 are collectively mounted as one and are detachable from the printer body. In such a condition, maintenance is easier. Further, in the case that parts or devices in the process cartridge 30 are damaged, it is easily and quickly recovered by the exchange of a process cartridge 30 so that the time of maintenance can be reduced.

Next, a cleaning of residual toner on the photoconductive drums 1Y, 1C, 1M, and 1K is explained below.

In the first embodiment, polymerized toner grains are close to a true sphere each and have high mean circularity while pulverized grains have low mean circularity due to random irregularity existing on the surface of the grains. Generally, toner grains with low mean circularity have a broad grain size distribution and are therefore noticeably irregular in the surface of the individual grain. Such toner grains are therefore noticeably different from each other in the amount of charge deposited by agitation and frictional charging by a doctor blade when being conveyed in the form of a developer layer. Consequently, the charge distribution of the toner grains in the developer becomes too broad to be evenly subject to an electric field for image transfer on a drum. By contrast, polymerized toner grains with high mean circularity all can be controlled in configuration with high accuracy and have therefore a narrow grain size distribution. Consequently, the difference in the amount of frictional charge between the toner grains and therefore the toner charge distribution decreases. This successfully increases the image transfer ratio to thereby reduce the amount of toner grains left on the drum after image transfer.

Toner grains that are desirably charged deposit on the latent image of the drum 1 with priority and are consumed thereby. As a result, the ratio of toner grains not desirably charged to the entire toner grains in the developing device 5 increases. Therefore, in the case of the pulverized toner grains or similar toner grains having low mean circularity and therefore a broad charge distribution, toner grains undesirably charged are left in the developing device 5 in a large amount due to repeated use. Such toner grains fail to accurately deposit on the latent image of the drum 1 although they are subject to the electric field in the developing zone. Therefore, when the mean circularity is low, background contamination, irregularity in dots, and other defects occur due to repeated use, lowering image quality.

Furthermore, the low mean circularity translates into an increase in area over which the toner grains contact the carrier grains, thereby easily causing a toner spent condition to occur. A toner spent condition, which refers to the filming of toner grains on carrier grains, grows worse with the elapse of time. A toner spent condition obstructs the frictional charging of fresh toner grains replenished to the developing device 5 and is also considered to degrade image quality.

By contrast, the toner grains with high mean circularity and therefore narrow charge distribution applied to the first embodiment contain a far smaller amount of toner grains of undesirable charge than the toner grains with low mean circularity. Such toner grains therefore cause a minimum of background contamination, minimum irregularity in dots, and other minimum defects despite a long time of use. Further, the high mean circularity reduces the area over which the toner grains contact carrier grains for thereby preventing a toner spent condition from easily occurring, so that high image quality is insured over a long period of time.

The toner applicable to the first embodiment may be produced by suspension polymerization that mixes a monomer, a starter, a colorant, and so forth and then polymerizes, washes, dries, and then executes post-processing with the mixture. Suspension polymerization may be replaced with emulsion polymerization, bulk polymerization, or solution polymerization, if desired.

Figure 4A:
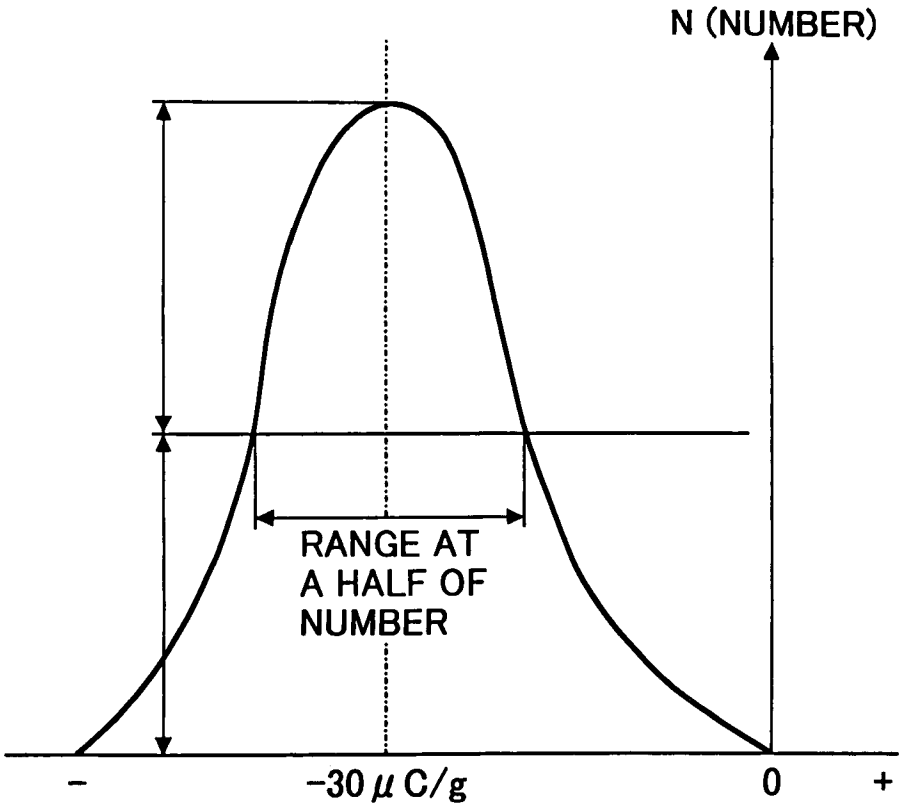
FIG. 4A is a graph showing a charge potential distribution of toner present on a drum just before image transfer.
Figure 4B:
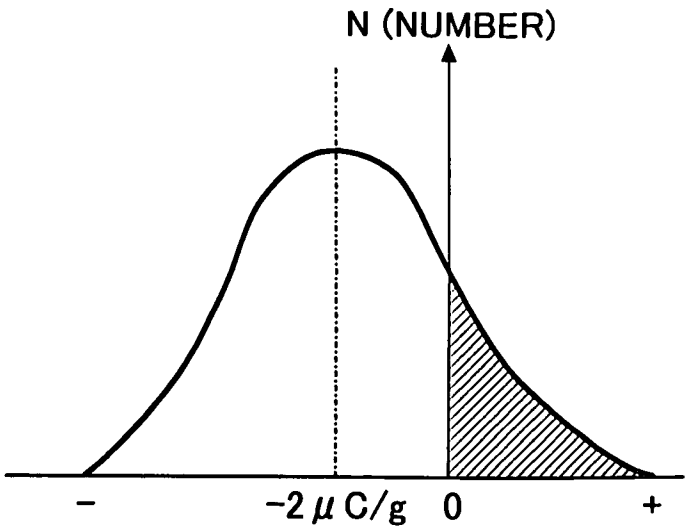
FIG. 4B is a graph showing a charge potential distribution of toner after image transfer.

FIG. 4A shows a graph for the charge potential distribution of the toner grains just before the transfer from the drum 1. FIG. 4B shows a graph for the charge potential distribution of the toner grains left on the drum 1 after the transfer from the drum 1. As shown in FIG. 4A, the amount of charge just before the transfer is distributed at both sides of substantially −30 uC/g; most of the toner grains are charged to a negative or regular polarity. As shown in FIG. 4B, the amount of charge left on the drum 1 after the transfer is distributed at both sides of substantially −2 uC/g. Generally, most of the toner grains left on the drum 1 after the transfer are defective grains unable to be charged to the expected polarity due to, e.g., defective composition. Therefore, part of the residual toner grains are charged to a positive (opposite) polarity due to, e.g., charge injection ascribable to the positive bias applied to the primary image transfer roller 14. This is why toner grains of opposite polarity exist, as indicated by a hatched portion in FIG. 4B.

Such toner grains having opposite polarity on the photoconductive drum 1 are conveyed to a corresponding position with charging roller 3*a* of the charging device 3 (hereinafter, called a "charging area") and are electrically deposited on the surface of the charging roller 3*a* applied by a negative bias. It is the same situation in the case that the charging roller 3*a* is closely apart from the surface of photoconductive drum 1 as stated above. When the toner grains having opposite polarity are deposited on the charging roller 3*a* in large quantities, a resistance or condition in the surface of the charging roller 3*a* is changed so that a start voltage between the photoconductive drum 1 and the charging roller 3*a* lacks uniformity. Therefore, even if the charging bias is the same, the preferable electrical potential on the photoconductive drum (−500 V) does not become uniform. As a result, a lack of uniformity for a density of the formed image arises. Also, an electrical current may be centered on a part of charging roller 3*a* not bearing toner in the case that toner is deposited on only a little part of a surface of charging roller 3*a*. Consequently, even if the charging bias is the same, the charged potential on the photoconductive drum 1 is higher than a preferable potential. As a result, a part receiving a light beam from the exposing device 4, i.e. a potential of the latent image area, shifts to a negative, and therefore a density of a formed image may be lessened. Also in the case that a part of the surface of charging roller 3*a* is deposited and covered by toner, an ability of the charging roller 3*a* is lessened so that the electrical potential of the surface of photoconductive drum 1 may be lessened. As a result, a part not receiving a light beam from the exposing device 4, i.e. a background part of a non-latent image (a background part of the photoconductive drum 1 not having a latent image formed thereat), shifts to a same electrical potential of a developing bias for developing roller 5*a*. Consequently, toner grains of unexpected potential are deposited on the background part of photoconductive drum 1 so that the formed image quality may be lowered.

Meanwhile, a majority of the residual toner still has a negative polarity as a regular charged toner. When the regular charged toner is conveyed to a charging area by charging roller 3*a*, this toner is not deposited on the charging roller 3*a* because the charging roller 3*a* is charged a charging bias. Further, when the regular charged toner is conveyed to a developing area, the magnetic carrier of developing roller 5*a* in the developing device 5 collects it, or the regular charged toner is used to form a regular image during an image forming process. That means that the regular charged toner has no effect on the image forming process. Therefore, in the background art, the most important point was how to make the toner grains of opposite polarity have no effect on the image forming process.

However, as a result of continued research by the present inventors, it has been discovered that, rather than the condition of residual toner deposited on the charging roller 3*a*, the condition of residual toner on the photoconductive drum 1 when a latent image by the exposing device 4 is formed has a larger effect on forming a clear image. That means, the important point for forming a clear image is, rather than how to improve the condition of the toner grains of opposite polarity deposited on charging roller 3*a*, how to improve the regular charged toner passing through the charging area to the latent image forming area. This is because it is not as important how not to deposit the residual toner on the charging roller 3*a*, but it is more important how not to deposit the residual toner on the photoconductive drum 1 at an image forming area after passing through the charging roller 3, to uniformly form a latent image by the exposing device 4.

In the first embodiment, the polarity of almost all of the residual toner is uniformly changed to a positive polarity opposite to a charging bias (negative), i.e. toner of a negative polarity (referred to as a regular polarity) is changed to a positive (or opposite) polarity from the regular polarity by toner polarity control device 40. That results in almost all of the residual toner being electronically deposited on charging roller 3*a* to be removed from photoconductive drum 1. Then, the residual toner deposited on charging roller 3*a* is uniformly changed to a regular polarity (negative polarity) by the bias applying blade 3*b*, and then is returned to the surface of photoconductive drum 1 at a preferable time. The mechanism and movement is described below. It is separately explained with respect to a process of controlling residual toner to have a positive polarity, a process of temporarily bearing the residual toner having a positive polarity and discharging the toner to a photoconductive drum 1 at a preferable time, and a process of collecting the toner after being discharged to the photoconductive drum 1.

First, explained below is a process of controlling a polarity for almost all of residual toner on a photoconductive drum 1.

Figure 1:
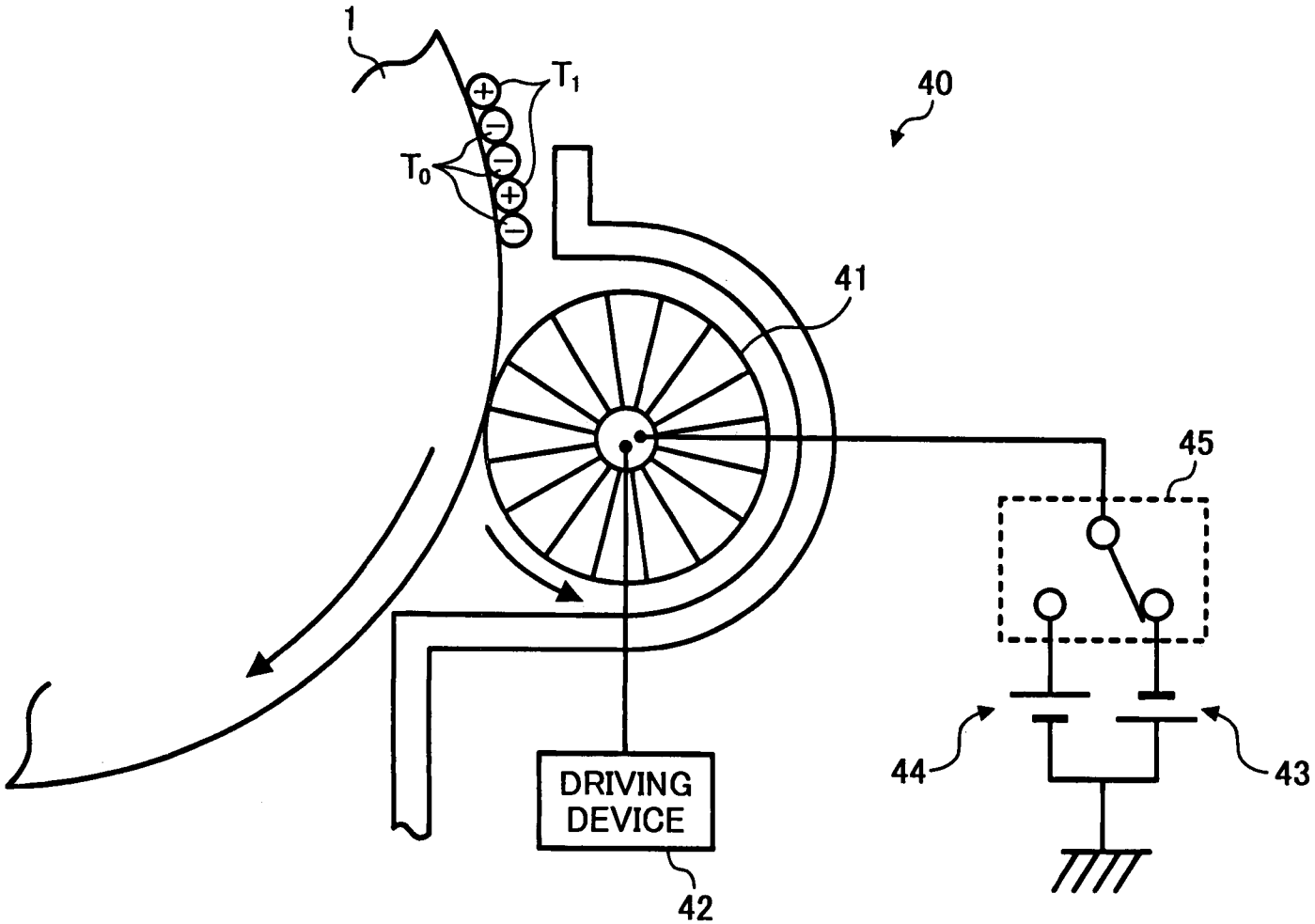
FIG. 1 is a sectional view showing a polarity-controlling device in a first embodiment of an image forming apparatus.

FIG. 1 shows a sectional drawing for a polarity-controlling device 40. This device contains a polarity-controlling roller 41, which contacts a surface of photoconductive drum 1 and is rotated as a moving element. The polarity-controlling roller 41 has a low resistance so that the polarity can be stably and uniformly changed. As a result, as explained below, an ability of holding a residual toner by a charging roller 3*a* is improved and a volume of residual toner that passes through a charging area is lessened. Also, it is preferable that the polarity controlling roller 41 has a low hardness so that the polarity-controlling roller 41 can widely contact the residual toner. In such an embodiment, the polarity controlling is further improved in a stably and uniform charge.

In the first embodiment, it is preferable that a polarity-controlling roller 41 is under 108 ohm·cm as the resistance and from 25 degree to 70 degree as Ascar-C hardness. In such a case, it is preferable that the polarity-controlling roller 41 is pressed into the photoconductive drum 1 in the range from 0.1 g/mm$^2$ to 30 g/mm$^2$. In the case that the hardness of the polarity controlling roller 41 is under 30 degree, it can be pressed by a small force such as 0.1 g/mm$^2$ to 10 g/mm$^2$ so that the polarity controlling roller 41 stably contacts the residual toner on photoconductive drum 1 and can also stably change the polarity. Further, since less force is needed, an abrasion of photoconductive drum 1 can also be lessened. In the case that the hardness of polarity controlling roller 41 is from 30 degree to 60 degree, it can be pressed onto photoconductive drum 1 in the range from 1 g/mm$^2$ to 10 g/mm$^2$ so that the polarity controlling roller 41 stably contacts the residual toner on photoconductive drum 1 and can also stably change the polarity. Further, in the case that the hardness of the polarity controlling roller 41 is from 60 degree to 70 degree, it can be pressed onto photoconductive drum 1 in the range from 5 g/mm$^2$ to 30 g/mm$^2$ so that the polarity controlling roller 41 stably contacts the residual toner on photoconductive drum 1 and can also stably change the polarity. Also, it is preferable that a material having a higher releasing ability with toner coats a surface of polarity controlling roller 41.

The polarity-controlling roller 41 is rotatably driven in the direction of an arrow shown FIG. 1 by a driving device 42. And, a first power source 43 or second power source 44 as first and second bias applying devices are selectably connected to the polarity controlling roller 41 so that the polarity controlling roller 41 can be applied a bias. Concretely, the selectable switch 45 is connected between these power sources 43 and 44 and the polarity controlling roller 41. A control unit in the printer can control the selectable switch 45. In the first embodiment, a bias applying device includes the first and second power sources 43 and 44 and the selectable switch 45. The first power source 43 can, e.g., charge the electrical potential of the surface of the polarity-controlling roller 41 to −200 V and the second power source 44 can charge the electrical potential to +700 V.

Before the part of photoconductive drum 1 onto which residual toner is deposited contacts the polarity-controlling roller 41 (referred to as a "roller contacting area"), the polarity-controlling roller 41 connects to second power source 44. As such, the polarity-controlling roller 41 is applied a bias so that the electrical potential of the surface becomes +700 V. Therefore, the polarity-controlling roller 41 contacts the surface of photoconductive drum 1 to charge only the regular (negatively) charged toner T0 to a positive (opposite) polarity. Then, after the residual toner is changed to a positive polarity, the positively charged toner can be passed through the roller contacting area on the condition that the photoconductive drum 1 still bears residual toner. As detailed, a photoconductive drum 1 is uniformly charged to −500 V by charging device 3. And then, the electrical potential at a part of a latent image becomes −50 V after a receipt of light from the exposing device 4. Consequently, after a process of developing the latent image and a process of transferring, the electrical potential of the latent image becomes 0 V. Almost all of the residual toner is deposited on the part of photoconductive drum 1 on which a latent image is formed. Then, the regular charged toner T0 having a negative polarity deposited on the part of photoconductive drum 1 is charged to +700 V bias by the polarity-controlling roller 41 at the roller contacting area. At the same time, the electrical potential of a background part, the part not having the latent image of −500 V, shifts to 0 V. Although the background part has deposited thereon the residual toner, the polarity controlling roller 41 can electrically charge the regular charged toner T0 having a negative polarity deposited on the background part. Therefore, a polarity of the regular negatively charged toner T0 is changed to a positive polarity so that the regular charged toner receives an electrostatic force toward photoconductive drum 1 at the roller contacting area. Therefore, the polarity of the regular charged toner T0 of the residual toner deposited on the photoconductive drum 1 is changed at the roller contacting area so that it can pass through the roller contacting area, on the condition it is deposited on the photoconductive drum 1.

Meanwhile, since an opposite charged toner T1 of the residual toner is already charged to the positive polarity, the opposite charged toner T1 receives an electrostatic force toward photoconductive drum 1 at the roller contacting area. Therefore, the opposite charged toner T1 is not charged so that it is still deposited on photoconductive drum 1 and can pass through the roller contacting area.

As a result, the polarity of almost all of the residual toner is uniformly set at a positive polarity at the roller contacting area so that it can pass through the roller contacting area on the condition it is deposited on the photoconductive drum 1.

In the first embodiment, the polarity-controlling roller 41 is driven by driving device 42 to move in the same direction of movement of photoconductive drum 1. In such an embodiment, a contacting time between the polarity-controlling roller 41 and the residual toner is longer so that the polarity of the regular charged toner T0 is correctly charged. Further, it is preferable that the polarity-controlling roller 41 is rotated faster than the photoconductive drum 1. In such a condition, the polarity-controlling roller 41 can loosen a condensed toner pressed on photoconductive drum 1 so that electrical charging of the toner is improved. In such an embodiment, the polarity-controlling roller 41 can move from 1.01 to 2.5 times faster than photoconductive drum 1 in a linear velocity at a place where the polarity-controlling roller 41 contacts the photoconductive drum 1, and if preferable from 1.03 to 2.0 times. When the movement speed is 1.01 times or below, loosening of the condensed toner is not improved. Also, when the movement speed is over 2.5 times, the toner may blow away even if a polarity-controlling roller 41 having a higher solid is used.

Further, in a case that a surface of the polarity controlling roller 41 has a brush form, it may cause the toner to blow away because the brush springs up at a moment it separates from photoconductive drum 1. However, in the first embodiment, the polarity controlling roller 41 is rotated in a same direction of photoconductive drum 1 at the contacting area, and thereby if residual toner is blown off the toner it is blown in a movement direction from the roller contacting area. As a result, it may make the printer inside dirty. Therefore, in the first embodiment, the polarity-controlling roller 41 having a smooth surface is used so that the residual toner is less blown and the pollution inside is also less.

Next, a process of temporarily holding and discharging is explained, i.e. after the charging roller 3*a* temporarily holds the residual toner T2 (FIGS. 5A, 5B) uniformly set to a positive polarity by a polarity controlling roller 41, the toner is distributed to the photoconductive drum 1 at a preferable time.

Figure 5B:
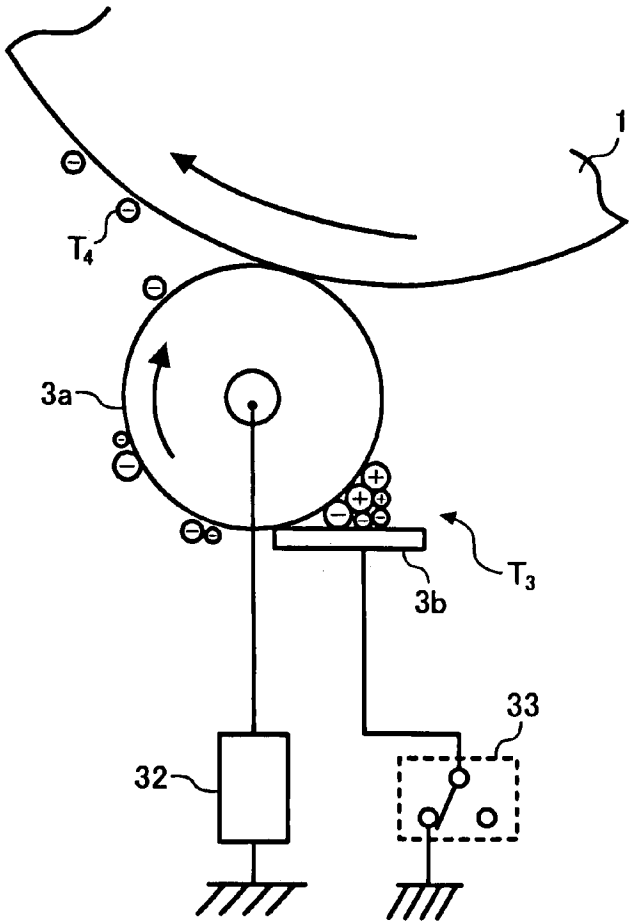
FIGS. 5A and 5B are sectional views showing a charging device in the first embodiment of the image forming apparatus.
Figure 5A:
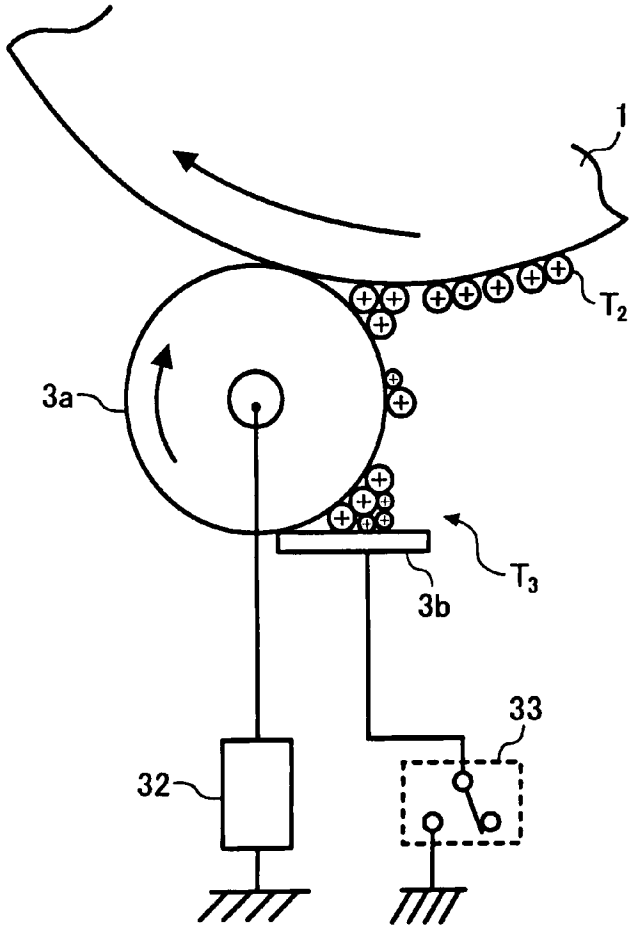

FIG. 5A is a sectional drawing showing a process of temporarily holding residual toner by charging roller 3*a*. FIG. 5B is a sectional drawing showing a process of discharging toner by charging roller 3*a*.

In the first embodiment, the charging roller 3*a* temporarily holds residual toner T2 all set to the positive polarity by the polarity-controlling roller 41, and then the charging roller 3*a* discharges residual toner T3 temporarily held, to photoconductive drum 1. In the first embodiment, during the printer image formation, in detail, from finishing an image forming of a current image to a next image forming to be started, the charging roller 3*a* discharges the toner after the polarity of residual toner T3 is changed to the regular polarity, i.e. changed to the negative polarity. Concretely, the charging roller 3*a* discharges the residual toner T3 after the charging roller 3*a* temporarily holds the residual toner T2 all set to a same positive opposite polarity at a charging area at an image forming process, and before a part of photoconductive drum 1 that should be charged by charging roller 3*a* on the next image forming process comes to the charging area. In such an embodiment, it is possible to collect the residual toner T3, to avoid having a negative effect on a next image forming process. In the case continued image forming is needed, it is preferable that the charging roller 3*a* discharges the residual toner T3 after the last image forming process. In such an embodiment, requiring a long time for a process of collecting the residual toner T3 can be prevented.

In detail, for the temporary holding process, the electrical potential of the last image forming process on the surface of photoconductive drum 1 bearing the residual toner T2 is set to a positive polarity by the polarity-controlling roller 41. In the first embodiment, the electrical potential is about −50 V. However, in the first embodiment, the second power source 44 connects to the polarity-controlling roller 41 during an image forming. That means the electrical potential of the polarity-controlling roller 41 is +700 V during an image forming. The electrical potential of the background part −500 V that does not have a part of the latent image and does not receive a light, has the charge thereof set to −50 V, the same as the electrical potential. As a result, the electrical potential of the background part of photoconductive drum 1 bearing the residual toner T2 is uniform at about −50 V. Then, when the background part arrives at the charging area, the residual toner T2 all set to the positive polarity works an electrostatic force toward the charging roller 3*a* of which electrical potential is −500 V. Therefore, the residual toner T2 passing through the roller contacting area of the polarity-controlling roller 41 is deposited on the surface of charging roller 3*a* by electrostatic force and then is held.

Consequently, as shown FIG. 5A, the residual toner T3, which is temporarily held on the charging roller 3*a*, is kept at the area where it is surrounded by the charging roller 3*a* and bias applying a blade 3*b* that contacts the charging roller 3*a* (hereinafter referred to as the "keeping area"). The bias applying blade 3*b* can be made of a metal such as stainless steel and the like, and an end of blade 3*b* is connected to a selectable switch 33. If the residual toner T3 is kept at the keeping area, the selectable switch 33 is electrically floated as shown in FIG. 5A. As a result, the electrical potential of the bias applying blade 3*b* is the same as that of the charging roller 3*a* so that there is no electrical potential at the keeping area. Also, the bias applying blade 3*b* presses to contact the charging roller 3*a* to limit a pass volume of the residual toner T3. In the first embodiment, a force of the bias applying blade 3*b* is adjusted so that a volume of the residual toner T3 to pass through between the charging roller 3*a* and the bias applying blade 3*b* is 0.1 mg/cm$^2$ or below, and preferably 0.05 mg/cm$^2$. As a result, even if the residual toner T3 is deposited on the charging roller 3*a* in a large volume, there is less toner on the surface of charging roller 3*a* facing a charging area, to prevent making an ability of charging poor, to maintain a uniform charging.

As details for a process of discharging, shown in FIG. 5B, the selectable switch 33 is connected to the ground at a time for discharging. As a result, the electrical potential of the bias applying blade 3*b* becomes 0 V so that there is a different electrical potential with the charging roller 3*a* having about −500 V. Therefore, the residual toner T3 starts to be charged by the charging roller 3*a*. As a result, the residual toner T3 changes its polarity to a negative polarity. Then, the residual toner T3 passes through the contacting portion, i.e. the keeping area, between the charging roller 3*a* and the bias applying blade 3*b*, and then is conveyed to the charging area on the condition of charging roller 3*a* bearing the residual toner T3. In the charging area, the residual toner T3 having a negative polarity receives an electrostatic force toward photoconductive drum 1 and is deposited on the photoconductive drum 1. Consequently, the residual toner T3 that was temporarily held on the surface of charging roller 3*a* is discharged to the surface of photoconductive drum 1.

In the research by the present inventor, it was discovered that the volume of toner grains to pass through the contacting portion during the discharging process is larger than that during the temporary holding process. The phenomenon has a good result because the volume of toner on the charging roller 3*a* during the charging is less, and also a time for discharging to photoconductive drum 1 is less. Although a basis of the phenomena is not discovered well, it seems to result from the difference between the electrical potential of charging roller 3*a* and the bias applying blade 3*b*.

Next, a process of collecting the residual toner T4 from the surface of the photoconductive drum 1 is explained.

In the first embodiment, a developing roller 5*a* in developing device 5 as a collecting device is applied a bias opposite to the developing bias, i.e. +200 V, from which the residual toner T4 deposited on the photoconductive drum 1 by discharging on the discharging process reaches the developing area, and to which the residual toner T4 passes thorough the developing area. As a result, the residual toner T4 receives an electrostatic force toward the developing roller 5*a* between the surface of the photoconductive drum 1 bearing the residual toner T4 that has a negative polarity, i.e. the regular polarity, and the surface of developing roller 5*a*. Therefore, the residual toner T4 is collected by the developing roller 5*a* or the developer deposited on the developing roller 5*a*. Consequently, the residual toner T4 is conveyed inside the developing device 5, and then is used as developer again after agitating and conveying by developing device 5.

In the first embodiment, in the case that the printer stops forming an image due to, e.g., a jam of transferring paper, it has to remove a large quantity of toner on photoconductive drum 1. In the first embodiment, the printer does not have a cleaning blade to remove toner, and therefore it is hard to remove toner. In such a case, the printer transfers the residual toner on photoconductive drum 1 onto the intermediate transfer belt 10. And then, the residual toner is removed from the intermediate transfer belt 10 by the belt-cleaning device 15. As explained above, the belt-cleaning device 15 includes a fur brush and cleaning blade so that it can remove a large quantity of the residual toner.

The power sources 43, 44 are connected to selectable switch 45 with the polarity-controlling roller 41, which normally connects to the second power source 44 that can apply a bias, and therefore an electrical potential on the polarity controlling roller 41 is +700 V. However, in the case that the photoconductive drum 1 has a large quantity of toner, the first power source 43 is selected to which the electrical potential on the polarity-controlling roller 41 is −200 V as a cleaning bias. Therefore, the residual toner is charged negatively at the roller contacting area as explained above so that the residual toner can easily transfer to the intermediate transfer belt 10. As a result, the residual toner can be easily removed.

Next, another embodiment of a polarity controlling device is explained below.

Although the embodiment above shows that the power sources 43 and 44 each are a direct power source, in the second embodiment below, the power source is applied in an AC-biased DC.

Figure 8:
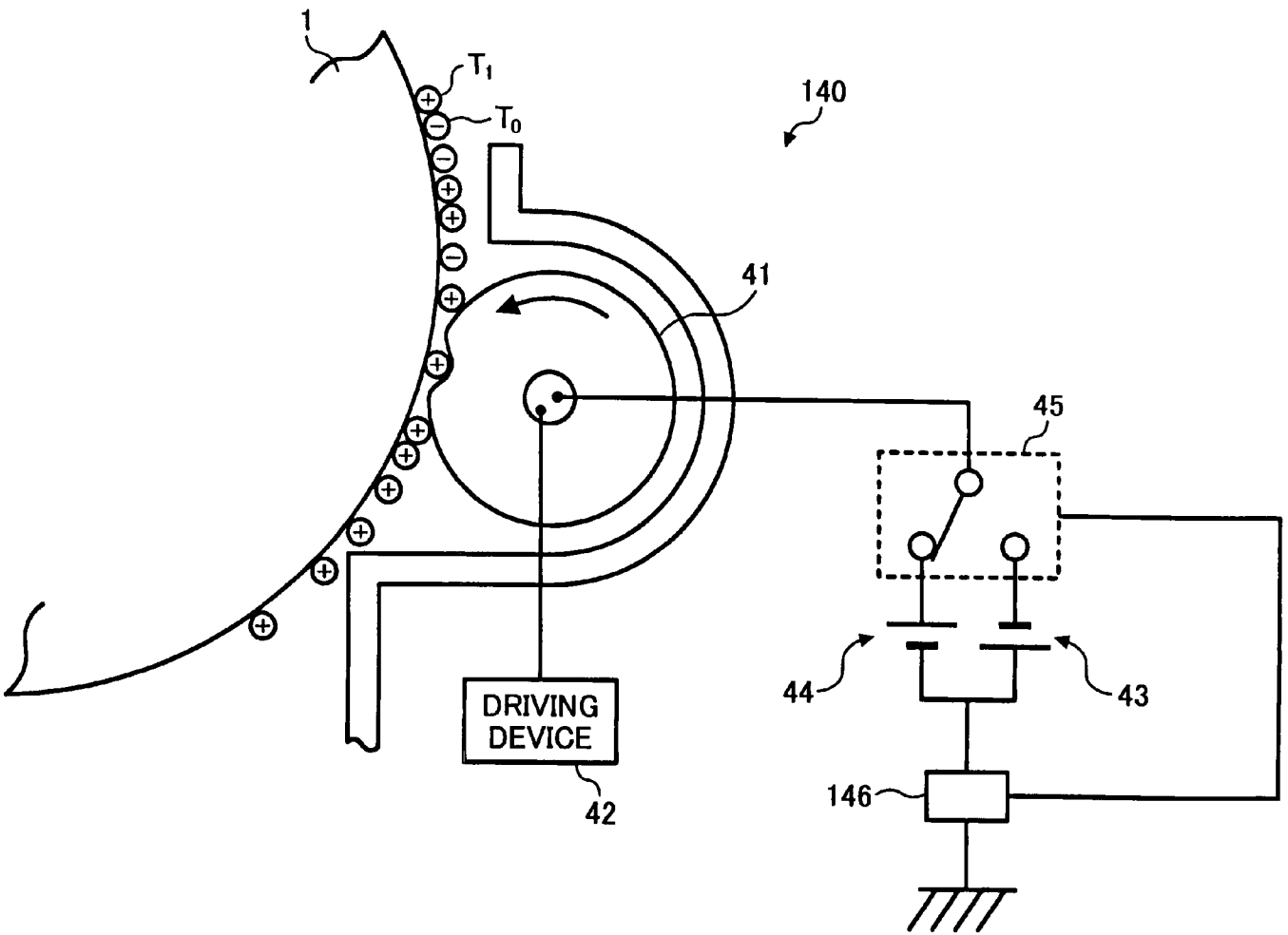
FIG. 8 is a sectional view showing a polarity-controlling device in a second embodiment of an image forming apparatus.

FIG. 8 shows a sectional drawing of the polarity-controlling device 140 in the second embodiment. The basic construction of the polarity-controlling device 140 is the same as the polarity-controlling device 40 explained above. However, in the second embodiment the first power source 43 and the second power source 44 connect to an AC power source 146. As a result, the polarity-controlling roller 41 is applied with a DC bias generated by the first power source 43 or the second power source 44, and with an AC bias generated by AC power source 146. The frequency of the AC can be from 500 Hz to 10,000 Hz, preferably from 1,000 Hz to 7,000 Hz. In the second embodiment, a bias applying device includes the first power source 43, the second power source 44, the AC power source 146, and the selectable switch 45. The AC power source 46 can select the frequency of the AC.

In the second embodiment, the AC bias does not have a function of changing the polarity of the residual toner, but of lessening the impedance of residual toner, and since the impedance of residual toner on photoconductive drum 1 is lessened, the ability of electrical charging is improved. In the case that the frequency of the AC bias is under 500 Hz, the polarity-controlling roller 41 may unexpectedly have mechanical vibrations. Also, in the case that the frequency of the AC bias is more than 10,000 Hz, there may be unexpected residual toner passing through the charging roller 3*a*. The Vpp peak to peak of the AC bias is preferably from 150 V to 1500 V.

The printer in the second embodiment includes a polarity controlling device 140, which charges the residual toner T0 and T1 to an opposite polarity (positive polarity) opposite to a regular polarity (negative polarity) after a part of a photoconductive drum 1 is conveyed to a transfer position with the preliminary transferring roller 14Y, 14C, 14M, and 14K, and before the part of photoconductive drum 1 is conveyed to a charging area charged by charging roller 3*a*. Since the polarity controlling device 140 can set the polarity of almost all of the residual toner to positive, the residual toner T2 is held by the charging roller 3*a*. Therefore, the residual toner T2 can be removed from photoconductive drum 1 before the residual toner coveys to a latent image area formed by the exposing device 4 as a latent image forming device. As a result, when the latent image is formed at the latent image area, the residual toner T2 is prevented from forming the latent image so that an image can be regularly formed. In addition, in the second embodiment, the residual toner can be removed without a cleaning blade, which has a strong ability for removal of toner. Therefore, in comparison with using a cleaning blade, a load to the driving device driving a photoconductive drum can be greatly reduced. Further, it is possible to utilize a smaller driving device, and the vibration of the printer body is lessened so that an image is stably formed.

Further, in the second embodiment, the polarity controlling device 40 includes a bias applying blade 3*b* as an electrical charging device contacting the surface of the charging roller 3*a*. The bias applying blade 3*b* sets the polarity of the residual toner T3 on the photoconductive drum 1 to the regular polarity (negative polarity). Further, the charging device 3 discharges the residual toner T4 to the photoconductive drum 1 after the bias applying blade 3*b* sets the polarity. In the second embodiment, since the residual toner T3 is discharged to the photoconductive drum 1 after all changing to the regular polarity, the developing device can use that toner in a regular development. Also, since the residual toner T4 discharged on the photoconductive drum 1 is at the regular polarity, the developing roller 5*a* can collect the residual toner T4 by a static electrical force.

In the second embodiment, the developing device 5 generates two types of bias to the developing roller 5*a*, with one toner on photoconductive drum 1 is moved to the latent image area, and with one residual toner T4 on photoconductive drum 1 is collected by developing roller 5*a*. As a result, it is not necessary to have a residual toner-collecting bottle to collect the residual toner so that the apparatus can be made small. Especially, it is preferable that the printer in the first embodiment has four photoconductive drums 1Y, 1C, 1M, and 1K, a so called tandem image forming apparatus. Further, the collecting mechanism to collect the residual toner T4 on photoconductive drum 1 is not limited to the developing devices 5. It is preferable that the intermediate transferring belt 10 is configured to collect the residual toner T4 after it is transferred from the photoconductive drums 1Y–1K to the intermediate transferring belt 10. In such an embodiment, since the residual toner T4 has a regular polarity, it is needed to apply the bias in a same direction as in the regular transferring process. As a result, the intermediate transferring belt 10 can collect the residual toner T4 from the photoconductive drums 1Y–1K. Therefore, the printer does not need a residual toner-collecting bottle and recycling toner-conveying path in the printer body. The polarity-controlling device 40 can be replaced by another device that can change the polarity of residual toner to the opposite polarity from a regular polarity so that the polarity controlling device 40 can be small. Therefore, the device can be made of a small size.

In the second embodiment, the polarity controlling device 140 includes a polarity controlling roller 41 moving with contact on photoconductive drum 1, a driving device 42 driving the polarity controlling roller 41 in the same linear direction with a rotation of the photoconductive drum 1, and a second power source 44 applying a bias to charge the residual toner to the opposite polarity (positive polarity). Therefore, in comparison with driving in opposite directions, there is a merit that the polarity controlling roller 41 can better contact the residual toner T0 and T1 on photoconductive drum 1. As a result, the residual toner T0 can receive an electric charge early so that almost all of the residual toner can be charged to the opposite polarity (positive polarity). Further, the charging roller 3*a* can bear the residual toner T2.

Further it is preferable that the polarity-controlling roller 41 is rotated faster than the photoconductive drum 1. In such a condition, there is a good result because the polarity-controlling roller 41 can loosen condensed toner pressed on photoconductive drum 1 so that electrical charging of the toner is improved. In such an embodiment, a movement speed of the polarity-controlling roller 41 can be from 1.01 to 2.5 times faster, and preferably from 1.03 to 2.0 times faster, than the photoconductive drum 1.

The frequency of the AC bias can be from 500 Hz to 10,000 Hz, preferably from 1,000 Hz to 7,000 Hz.

In the second embodiment, the polarity-controlling device 140 includes the polarity controlling roller 41, the first power source 43, the second power source 44, and the selectable switch 45 as explained above. When a bias for charging electricity is applied, the charging roller 3*a* can bear the residual toner after the polarity is changed to a positive polarity. Meanwhile, when a cleaning bias is applied, it can easily remove the residual toner as explained above. Also, in the case that the polarity controlling roller 41 bears the residual toner having an unstable polarity, that toner is discharged onto photoconductive drum 1 after the cleaning bias is applied.

Especially, in the second embodiment, the bias is DC in the opposite polarity (positive polarity) with AC, and thereby the impedance of residual toner on photoconductive drum 1 is lessened, and the electrical charging ability is improved.

In the second embodiment, the printer detachably mounts a process cartridge having at least photoconductive drum 1 and polarity controlling device 140. Therefore, in the case that the parts mounted in the process cartridge reach their end of life, or need any maintenance, the process cartridge is only exchanged with a new one to recover if maintenance is needed. Especially, it is preferable to exchange the polarity-controlling device 40 together with photoconductive drum 1 and the like, included in the process cartridge.

Next, a toner used in the first and second embodiments is explained below.

The toner used by the printer is preferably approximately spherical shape. Concretely, it is preferable that the mean circularity of the toner grain is 0.93 or above. The toner is difficult to remove by a cleaning blade if toner having a high circularity is used, because the toner goes to the nip between a photoconductive drum 1 and the cleaning blade. However, since the average of transferring the toner is higher, it is preferable to reduce the volume of residual toner. Therefore, as the printer of the first embodiment, it is highly preferable that the charging roller 3*a* removes the residual toner having the higher circularity without a cleaning blade. In addition, the toner having higher circularity has smaller mechanical force with objects, such as the photoconductive drum 1 or charging roller 5*a*. Therefore, it is preferable that the charging roller 5*a* can temporarily hold or discharge the toner easier.

Figure 6A:
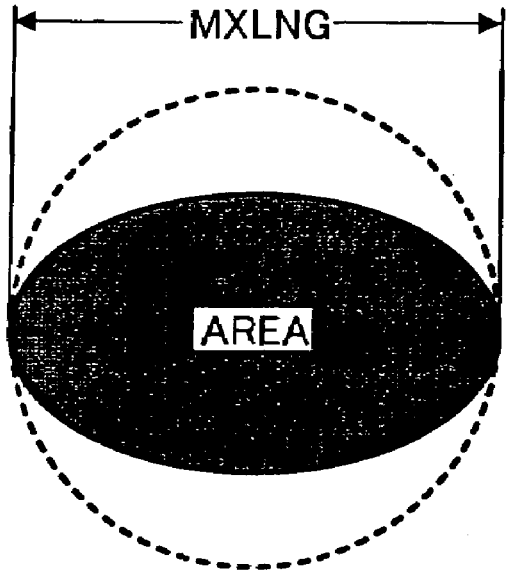
FIG. 6A is a diagram for explaining a shape factor SF-1.
Figure 6B:
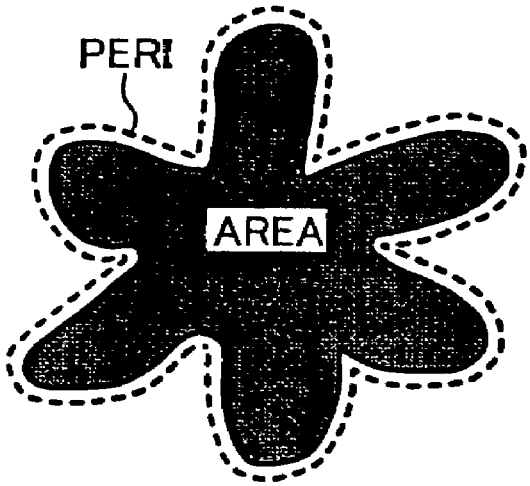
FIG. 6B is a diagram for explaining a shape factor SF-2.

Furthermore, the toner is preferably a toner that can be defined by the shape factors SF-1 and SF-2 described further below. FIGS. 6A and 6B are diagrams each schematically showing a toner shape, wherein FIG. 6A is a diagram for explaining the shape factor SF-1, while FIG. 6B is a diagram for explaining the shape factor SF-2.

The shape factor SF-1 indicates a ratio of roundness of the toner shape, and is expressed by a first equation (1) shown below, in which a square of a maximum length MXLNG of the shape formed by projecting the toner onto a two-dimensional plane is divided by a graphic area AREA, and is then multiplied by 100π/4.

$$SF\text{-}1=\{(MXLNG)2/\mathrm{AREA}\}\cdot(100p/4) \quad (1)$$

When SF-1 is 100, the toner shape is spherical. As SF-1 is larger, the toner loses its shape more.

Meanwhile, the shape factor SF-2 indicates a ratio of a concavity and a convexity of the toner shape, and is expressed by the second equation (2) shown below, in which a square of a perimeter PERI of a graphic formed by projecting the toner onto a two-dimensional plane is divided by a graphic area AREA, and is then multiplied by 100p/4.

$$SF\text{-}2=\{(PERI)2/\mathrm{AREA}\}\cdot(100p/4) \quad (2)$$

When SF-2 is 100, no concavity or convexity is present on the surface of the toner. As SF-2 is larger, concavities and convexities are more conspicuous.

The shape factors were calculated in a manner such that, specifically, the toner was photographed with a scanning electron microscope (S-800 manufactured by Hitachi, Ltd.), and the photographic image was introduced to an image analyzing apparatus (LUSEX3 manufactured by Nireco Corporation) for analysis.

Also, the particle of the toner for use in the developing unit has an approximately spherical shape defined as described below.

Figure 7A:
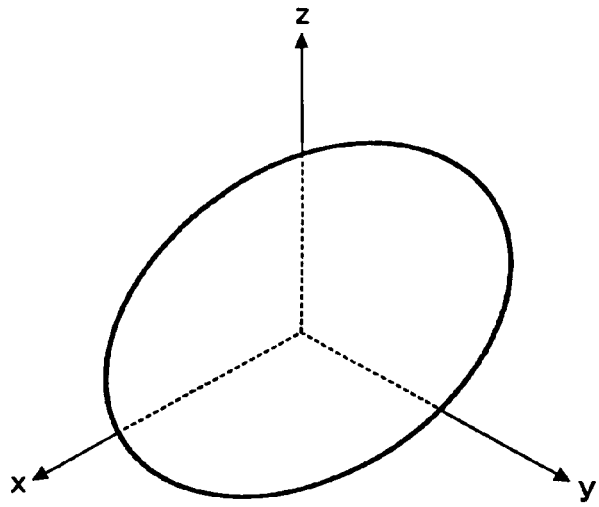
FIG. 7A to 7C are diagrams schematically showing toner shapes.
Figure 7B:
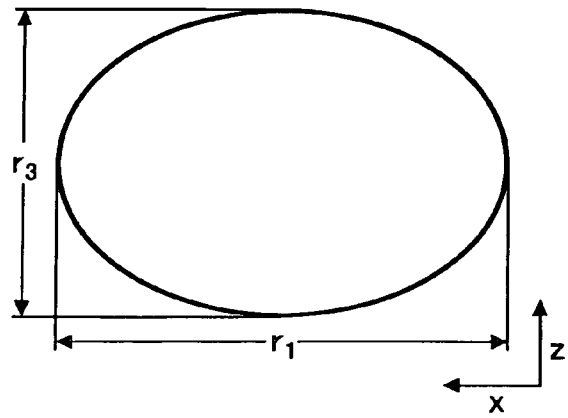
Figure 7C:
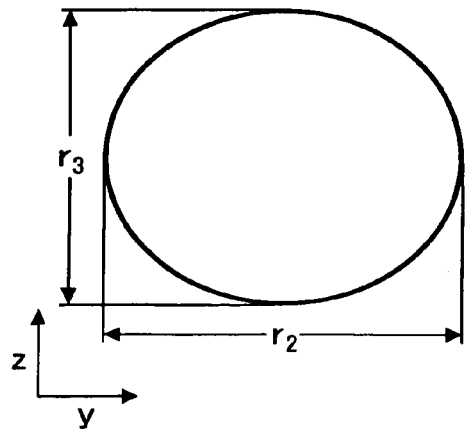

FIGS. 7A through 7C are diagrams schematically showing the toner shapes according to the present invention. When the particle of the toner having an approximately spherical shape is defined by a major axis r1, a minor axis r2, and a thickness r3, where r1≧r2≧r3, the toner according to the present invention preferably has a ratio between the major axis r1 and the minor axis r2 (r2/r1) (see FIG. 7B) in a range of 0.5 to 1.0, and a ratio between the thickness r3 and the minor axis r2 (r3/r2) (see FIG. 7C) in a range of 0.7 to 1.0. If the ratio between the major axis and the minor axis (r2/r1) is less than 0.5, the toner particle loses its spherical shape, thereby degrading the dot reproducibility and transfer efficiency. In this case, a high-quality image cannot be obtained. Also, if the ratio between the thickness and the minor axis (r3/r2) is less than 0.7, the toner particle has a shape close to a flat shape. Therefore, a high transfer rate as in a spherical toner cannot be achieved. Particularly, if the ratio between the thickness and the minor axis (r3/r2) is 1.0, the toner particle becomes a rotator with its main axis being taken as a rotational axis, thereby improving a fluidity of toners. Note that r1, r2, and r3 were photographed with a scanning electron microscope (SEM) at different viewing angles and measured while being observed.

In the toner according to the present invention, both the SF-1 and the SF-2 are preferably in a range of 100 to 180. When the toner shape is closer to a ball shape, a contact among toners is a point contact, thereby reducing absorbability among toners and therefore increasing a fluidity thereamong. Also, absorbability between the toners and the photosensitive drum 1 is also reduced, thereby increasing the transfer ratio. Therefore, the toner shape factors SF-1 and SF-2 are preferably large to a degree. However, if they are too large, the toners are scattered over the image, thereby degrading the image quality, because it is hard to control a polarity of toner grains by which the charging roller 3*a* temporarily holds the residual toner T2 or by which the charging roller 3*a* discharges the residual toner 3*a* on the photoconductive drum 1. Therefore, SF-1 and SF-2 preferably do not exceed 180.

In the present image forming apparatus, a volume-mean grain size Dv is preferably from 3 micrometers to 8 micrometers. Also a ratio of the volume-mean grain size Dv and number-mean grain size Dn, i.e. Dv/Dn, is preferably from 1.00 to 1.40, so that the toner can improve the reproducibility of fine lines more.

By making the particle diameter sharpened, a toner-charge-amount distribution can be made uniform. It is preferable that the charging roller 5*a* deposit residual toner from photoconductive drum 1 as in the above embodiments.

The toner exemplarily used in the image forming apparatus according to the present invention is a toner obtained in a water-type solvent through either one or both of cross-linking reaction and elongating reaction of a toner material liquid obtained by dispersing polyester prepolymer polyester, a colorant, and a release agent each at least including a function of a nitrogen atom in an organic solvent. Hereinafter, components of the toner and a toner manufacturing scheme are described.

The toner according to the present invention includes polyester modified (i). Polyester modified (i) is in a state such that polyester resin includes a bond group other than that of an ester bond, or such that polyester includes resin components of different structures being bonded through a covalent bond or ion bond. Specifically, a function group, such as an isocyanate group, reacting with a carboxylic acid group and a hydroxyl group is introduced at a terminal of polyester. Furthermore, the resultant polyester is reacted with a compound including active hydrogen to form polyester modified at the terminal.

Examples of polyester modified are urea polyester modified obtained through reaction between polyester prepolymer (A) having an isocyanate group and amines (B). An example of polyester prepolymer (A) having an isocyanate group is condensation polymer of polyhydric alcohol (PO) and polyvalent carboxylate (PC) with polyester having an active hydrogen group further being reacted with a polyvalent isocyanate compound (PIC). Examples of the active hydrogen group included in the polyester are a hydroxyl group (alcoholic hydroxyl group and phenolic hydroxyl group), an amino group, a carboxyl group, and a mercapto group. Of these groups, the alcoholic hydroxyl group is preferable.

Examples of polyhydric alcohol (PO) are dihydric alcohol (DIO), and trihydric or higher alcohol (TO), and (DIO) alone or a mixture of (DIO) and a small amount of (TO) are preferable. Examples of dihydric alcohol (DIO) are alkylene glycol (such as ethylene glycol, 1,2-propylene glycol, 1,3-propylene glycol, 1,4-butanediol, 1,6-hexanediol); alkylene ether glycol (such as diethylene glycol, triethylene glycol, dipropylene glycol, polyethylene glycol, polypropylene glycol, and polytetramethylene ether glycol); alicyclic diol (such as 1,4-cyclohexanedimethanol and hydrogenerated bisphenol A), bisphenols (such as bisphenol A, bisphenol F, and bisphenol S); alkylene oxide additives (such as ethylene oxide, propylene oxide, and butylene oxide) of alicyclic diol stated above; and alkylene oxide additives (such as ethylene oxide, propylene oxide, and butylene oxide) of bisphenols stated above. Of these, alkylene glycol with a carbon number of 2 to 12 and alkylene oxide additives of biphenols are preferable. More preferable is a combination of alkylene oxide additives of biphenols and alkylene glycol with a carbon number of 2 to 12. Examples of trihydric or higher alcohol (TO) are polyhydric fatty alcohol of trivalent to octavalent or higher (such as glycerin, trimethylole ethane, trimethylolpropane, pentaerythritol, and sorbitol); trivalent or higher phenols (such as trisphenol PA, phenol novolac, and cresol novolac); and alkylene oxide additives of trivalent or higher polyphenols.

Examples of polyvalent carboxylate (PC) are divalent carboxylate (DIC), and trivalent or higher carboxylate (TC), and (DIC) alone or a mixture of (DIC) and a small amount of (TC) are preferable. Examples of divalent carboxylate (DIC) are alkylenedicarboxylate (such as sucinic acid, adipic acid, and sebacic acid); alkenylenedicarboxylate (such as maleic acid and fumaric acid); aromatic dicarboxylate (such as phthalic acid, isophthalic acid, terephthalic acid, and naphthalenedicarboxylate). Of these, alkylenedicarboxylate with a carbon number of 4 to 20 and aromatic dicarboxylate with a carbon number of 8 to 20 are preferable. Examples of trivalent or higher carboxylate (TC) are aromatic polyvalent carboxylate with a carbon number of 9 to 20 (such as trimellitic acid and pyromellitic acid). Examples of polyvalent carboxylate (PC) are obtained by using acid anhydride of the above or lower alkyl ester (such as methyl ester and isopropyl ester) for reaction with polyhydric alcohol (PO).

As for a ratio of polyhydric alcohol (PO) and polyvalent carboxylate, an equivalent ratio [OH]/[COOH] between the hydroxyl group [OH] and the carboxyl group [COOH] is normally 2/1 to 1/1, preferably 1.5/1 to 1/1, and more preferably 1.3/1 to 1.02/1.

Examples of the polyvalent isocyanate compound (PIC) are aliphatic polyvalent isocyanate (such as tetramethylene isocyanate, hexamethylene isocyanate, and 2,6-diisocyanatomethyl caproate); alicyclic polyisocyanate (such as isophoronediisocyanate and cyclohexylmethane diisocyanate); aromatic diisocyanate (such as tolylenediisocyanate and diphenylmethane diisocyanate); aromatic aliphatic diisocyanate (such as $\alpha,\alpha,\alpha',\alpha'$-tetramethyl xylylene diisocyanate); isocyanates; a compound formed by blocking polyisocyanate described above with a phenol derivative, oxime, caprolactam, or the like; and a combination of at least two of these compounds.

As for a ratio of the polyvalent isocyanate compound (PIC), an equivalent ratio [NCO]/[OH] between the isocyanate group [NCO] and the hydroxyl group [OH] included in polyester is normally 5/1 to 1/1, preferably 4/1 to 1.2/1, and more preferably 2.5/1 to 1.5/1. If [NCO]/[OH] exceeds 5, low-temperature fixability is deteriorated. If a molar ratio of [NCO] is less than 1, when urea polyester modified is used, the amount of urea in that ester is low, thereby deteriorating the resistance to hot offset.

The amount of the polyvalent isocyanate compound (PIC) in polyesterprepolymer (A) having an isocyanate group is normally 0.5 weight-percent to 40 weight-percent, preferably 1 weight-percent to 30 weight-percent, and more preferably 2 weight-percent to 20 weight-percent. If the amount is less than 0.5 weight-percent, the resistance to hot offset is deteriorated. This is also disadvantageous in view of compatibility between heat resistance preservability and low-temperature fixability. Also, if the amount exceeds 40 weight-percent, the low-temperature fixability is deteriorated.

The number of isocyanate groups contained per molecule in polyesterprepolymer (A) having isocyanate groups is normally at least 1.0, preferably 1.5 to 3, and more preferably 1.8 to 2.5. If the number is less than 1, the amount of molecular weight of urea polyester modified is decreased, thereby deteriorating the resistance to hot offset.

Next, examples of amines (B) to be reacted with polyester prepolymer (A) are a divalent amine compound (B1), a trivalent or higher amine compound (B2), amino alcohol (B3), amino mercaptan (B4), amino acid (B5), and a compound (B6) obtained by blocking the amino group of B1 to B5.

Examples of the divalent amine compound (B1) are aromatic diamine (such as phenylenediamine, diethyltoluenediamine, and 4,4'-diaminodiphenylmethane); alicyclic diamine (such as 4,4'-diamino-3,3'-dimethyldicyclohexylmethane, diaminecyclohexane, and isophoronediamine); alophatic diamine (such as ethylenediamine, tetramethylenediamine, and hexamethylenediamine). Examples of the trivalent or higher amine compound (B2) are diethylenetriamine and triethylenetetramine. Examples of amino alcohol (B3) are ethanolamine and hydroxyethylaniline. Examples of amino mercaptan (B4) are aminoethylmercaptan and aminopropylmercaptan. Examples of amino acid (B5) are aminopropionic acid and aminocaproic acid. Examples of the compound (B6) obtained by blocking the amino group of B1 to B5 are a ketimine compound obtained from aminos and ketones (such as acetone, methyl ethyl ketone, and methyl isobutyl ketone) and an oxazolidine compound. Of these amines (B), preferable are B1 and a mixture of B1 and a small amount of B2.

As for a ratio of the amines (B), an equivalent ratio [NCO]/[NHx] between the isocyanate group [NCO] included in polyester prepolymer (A) having an isocyanate group and the amino group [NHx] included in the amines (B) is normally 1/2 to 2/1, preferably 1.5/1 to 1/1.5, and more preferably 1.2/1 to 1/1.2. If [NCO]/[NHx] exceeds 2 or is less than 1/2, the molecular weight of urea polyester modified is reduced, thereby deteriorating the resistance to hot offset.

Also, the urea polyester modified may contain a urethane bond as well as a urea bond. A molar ratio between the amount of urea bond and the amount of urethane bond is normally 100/0 to 10/90, preferably 80/20 to 20/80, and more preferably 60/40 to 30/70. If the molar ratio of the urea bond is less than 10 percent, resistance to hot offset is deteriorated.

Polyester modified (i) for use in the present invention is manufactured through a one-shot scheme or a prepolymer scheme. A weight-average molecular weight of polyester modified (i) is normally not less than 10000, preferably 20000 to 10000000, and more preferably 30000 to 1000000. At this time, a peak molecular weight is preferably 1000 to 10000. If the weight is less than 1000, and an elongating reaction is hard to occur, elasticity is low, thereby deteriorating resistance to hot offset. Meanwhile, if the weight exceeds 10000, the fixability is decreased and manufacturing problems in particle formation and pulverization become complex. A number-average molecular weight of polyester modified (i) is not particularly restrictive when polyester unmodified (ii), which will be described further below, is also used, and may be any that allow the weight-average molecular weight to be easily obtained. If (i) alone is used, the number-average molecular weight is normally not more than 20000, preferably 1000 to 10000, and more preferably 2000 to 8000. If the amount exceeds 20000, the low-temperature fixability and gloss that can be achieved when the toner is used for a full-color apparatus is deteriorated.

In either one or both of cross-linking reaction and elongating reaction between polyester prepolymer (A) and amines (B) for obtaining polyester modified (i), an inhibitor is used as required to adjust the molecular weight of urea polyester modified to be obtained. Examples of the inhibitor are monoamine (such as diethylamine, dibutylamine, butylamine, and laurylamine), and a compound obtained by blocking these amines (such as a ketimine compound).

In the present invention, only polyester modified (i) as described above can be used alone, and also this (i) can be used with polyester unmodified (ii) being included as a binder resin component. In combination with (ii), gloss is improved when the toner is used for a full-color apparatus having low-temperature fixability. This is preferable compared with the case of using (i) alone. Examples of (ii) are similar to those of polyester components of (i) described above, such as condensation polymer of polyhydric alcohol (PO) and polyvalent carboxylate (PC), and preferable examples are also similar to those of (i). Also, (ii) are not only polyester non-modified, but also polyester modified through a chemical bond other than a urea bond, such as polyester modified through a urethane bond. Preferably, (i) and (ii) are at least partially compatible with each other in view of low-temperature fixability and resistance to hot offset. Therefore, the polyester components of (i) and (ii) are preferably similar in composition to each other. A weight ratio between (i) and (ii) when (ii) is included is normally 5/95 to 80/20, preferably 5/95 to 30/7, more preferably 5/95 to 25/75, and particularly preferably 7/93 to 20/80. If the weight ratio of (i) is less than 5 percent, resistance to hot offset is deteriorated. This is also disadvantageous in view of compatibility between heat resistance preservability and low-temperature fixability.

A peak molecule weight of (ii) is normally 1000 to 10000, preferably 2000 to 8000, and more preferably 2000 to 5000. If the weight is less than 1000, heat resistance preservability is deteriorated. If the weight exceeds 10000, low-temperature fixability is deteriorated. The hydroxyl value (ii) is preferably equal to or more than 5, more preferably 10 to 120, and particularly preferably 20 to 80. The value less than 5 is disadvantageous in view of compatibility between heat resistance preservability and low-temperature fixability. The acid value of (ii) is preferably 1 to 5, and more preferably 2 to 4. Since high-acid-value wax is used, a low-acid value binder is easy to match with the toner for use in a two-component-system developer because such a binder leads to charging and a high-volume resistance.

A glass transition point (Tg) of binder resin is normally at 35° C. to 70° C., and preferably at 55° C. to 65° C. If the point is at less than 35° C., heat resistance preservability of the toner is deteriorated. If the point is at a temperature exceeding 70° C., low-temperature fixability is insufficient. Since urea polyester modified is prone to be present on the surfaces of toner main particles obtained, the toner according to the present invention shows a tendency to have an excellent heat resistance preservability even if the glass transition point is low, compared with known polyester toner.

As a colorant, any known dyes and pigments can be used. Examples are carbon black, nigrosine dye, iron black, naphthol yellow S, Hansa yellow (10G, 5G, G), cadmium yellow, yellow iron oxide, ocher, chrome yellow, titanium yellow, polyazo yellow, oil yellow, Hansa yellow (GR, A, RN, R), pigment yellow L, benzidine yellow (G, GR), permanent yellow (NCG), Vulcan fast yellow (5G, R), tartrazine lake, quinoline yellow lake, "ansurazan" yellow BGL, isoindolinone yellow, colcothar, red lead, vermilion lead, cadmium red, cadmium mercury red, antimony vermilion, permanent red 4R, para red, "faise" red, parachlorortho nitoroaniline red, lithol fast scarlet G, brilliant fast scarlet, brilliant carmine BS, permanent red (F2R, F4R, FRL, FRLL, F4RH), fast scarlet VD, Vulcan Fast Rubine B, brilliant scarlet G, Lithol Rubine GX, permanent red F5R, brilliant carmine 6B, pigment scarlet 3B, Bordeaux 5B, toluidine maroon, permanent Bordeaux F2K, Helio Bordeaux BL, Bordeaux 10B, BON maroon light, BON maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, "perinon" orange, oil orange, cobalt blue, cerulean blue, alkali blue lake, peacock blue lake, victoria blue lake, organic phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, hydrozincite, "ritobon" and mixtures thereof. The amount of colorant with respect to the toner is normally 1 weight-percent to 15 weight-percent, and preferably 3 weight-percent to 10 weight-percent.

The colorant can be used as a masterbatch combined with resin. Examples of binder resin for use in manufacturing a masterbatch or binder resin mixed with a masterbatch are styrenes, such as polystyrene, poly-p-chlorostyrene, and polyvinyl toluene and polymer of their substitution products, or copolymer of styrenes mentioned above and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic resin, rosin, rosin modified, terpene resin, aliphatic or alicyclic hydrocarbon resin, aromatic petroleum resin, chlorinated paraffin, and paraffin wax. These exemplary binder resins can be used alone or in combination.

As an electric charge control agent, any known such agents can be used. Examples are nigrosine dye, triphenylmethane dye, chrome-containing metal complex dye, chelate molybdate pigment, rhodamine dye, alkoxy amine, quaternary ammonium salt (including fluorine-modified quaternary ammonium salt), alkylamide, phosphorus simple substance or its compound, tungsten simple substance or its compound, fluorine activator, salicylate metal salt, and salicylate derivative metal salt. Specifically, Bontron 03 of nigrosine dye, Bontron P-51 of quaternary ammonium salt, Bontron S-34 of metal-containing azo dye, E-82 of oxynaphthoic acid metal complex, E-84 of salicylate metal complex, and E-89 of phenol condensate (which are manufactured by Orient Chemical Industries, Ltd.); TP-302 and TP-415 of quaternary ammonium salt molybdenum complex (which are manufactured by Hodogaya Chemical Co., Ltd.); copy charge PSY VP2038 of quaternary ammonium salt, copy blue PR of a triphenylmethan derivative, and copy charge NEG VP2036 and copy charge NX VP434 (which are manufactured by Hoechst AG); LRA-901, LR-147 of boron complex (which is manufactured by Japan Carlit Co., Ltd.), copper phthalocyanine, perylene, quinacridon, azo pigment, and high polymer compounds having a functional group, such as a sulfonic acid group, a carboxyl group, and a quaternary ammonium salt group. Of these, a substance negatively controlling the toner is particularly preferable for use.

The amount of use of an electric charge control agent is determined depending on the toner manufacturing scheme, including the type of the binder resin, the presence or absence of an additive for use as required, and the dispersion scheme, and therefore cannot be uniquely defined. Preferably, the binder resin is used in an amount of 0.1 part-by-weight to 10 parts-by-weight per 100 parts-by-weight of binder resin. A preferable range is 0.2 part-by-weight to 5 parts-by-weight. When the amount exceeds 10 parts-by-weight, the electric charge of the toner is too large, thereby reducing the effect of the electric charge control agent and increasing electrostatic attraction with the development roller. This reduces fluidity of a development agent and image density.

As a release agent, low-melting wax with a melting point of 50° C. to 120° C. is used to operate between the fixing roller and the toner interface more effectively as a release agent in dispersion with binder resin. This is effective to high-temperature offset without requiring a release agent, such as oil, to be applied to the fixing roller. Examples of such a wax component are as follows. As waxes, examples are vegetable wax, such as carnauba wax, cotton wax, wood wax, and rice wax; animal wax, such as bees wax and lanolin; mineral wax, such as ozokerite and selsyn; and petroleum wax, such as paraffin, microcrystalline and petrolatum. Also, other than the natural wax, examples are synthetic hydrocarbon wax, such as Fischer-Tropsch wax and polyethylene wax; and synthetic wax, such as ester, ketone, and ether. Furthermore, crystalline polymer having a long alkyl group in a side chain can also be used, such as fatty amide, such as 12-hydroxystearamide, stearamide, phthalic anhydride imide, and chlorinated hydrocarbon; and crystalline polymer resin of a low molecular weight, such as poly-n-stearyl methacrylate; homopolymer of polyacrylate, such as poly-n-lauryl methacrylate, or its copolymer (for example, n-stearyl acrylate-ethyl methacrylate).

The electric charge control agent and the release agent can be melted and mixed with masterbatch and binder resin, or, as a matter of course, can be added when being dissolved and dispersed in organic solvent.

As an external additive for helping fluidity, development ability, electrostatic property of the toner particles, inorganic fine particles are preferably used. The diameter of a primary particle of such inorganic fine particles is preferably 5×10-3 micrometer to 2 micrometers, and particularly 5×10-3 micrometer to 0.5 micrometer. Also, a specific surface through the BET scheme is preferably 20 m2/g to 500 m2/g. A ratio of use of the inorganic fine particles is preferably 0.01 weight-percent to 5 weight-percent with respect to the toner, and particularly 0.01 weight-percent to 2.0 weight-percent.

Specific examples of inorganic fine particles are, for example, silica, alumina, titanium oxide, barium titanate, magnesium titanate, calcium titanate, strontium titanate, zinc oxide, tin oxide, silica sand, clay, mica, wollastonite, diatomaceous earth, chromic oxide, ceric oxide, colcothar, antimonic troxide, magnesium oxide, zirconium oxide, barium sulfate, barium carbonate, calcium carbonate, silicon carbide, and silicon nitride. Of these, as a liquid additive, a combination of hydrophobic silica fine particles and hydrophobic titanium oxide fine particles is preferable. Particularly when these fine particles with an average particle diameter of 5×10-2 micrometer or less are shaken and mixed for use, an electrostatic force with the toner and a Van der Waals force are significantly improved. Therefore, even with shaking and mixing inside the developing device being performed for obtaining a desired charge level, the liquid additive can be prevented from being detached from the toner. Thus, high image quality without firefly and reduction in transfer residual toner can be achieved.

Titanium oxide fine particles are excellent in environmental stability and image density stability, but tend to be deteriorated in charging startup characteristics. Therefore, when the amount of addition of titanium oxide fine particles is larger than the amount of addition of silica fine particles, such a side effect may be large. However, the amount of addition of hydrophobic silica fine particles and the amount of addition of hydrophobic titanium oxide fine particles are in a range of 0.3 weight-percent to 1.5 weight-percent, the charging startup characteristics are not so impaired, and desired charging startup characteristics can be obtained. That is, even with repeated copying, stable image quality can be achieved.

Other than the above, a lubricant may be externally added to the toner. Examples of the lubricant externally added to the toner are fine particles of aliphatic metal salt, such as zinc stearate, and fluororesin, such as polytetrafluoroethylene. With the toner also being added with a lubricant, when a residual transfer toner on the photosensitive member 5 is cleaned by the cleaning blade 15*a*, the toner is pressed to a side of the photosensitive member 5. Then, the lubricant on the surface of the toner is extended together with the lubricant supplied onto the photosensitive member 5 from the lubricant applying unit 17 to form a thin film on the surface of the photosensitive member 5. For example, when an image with a high image area ratio is formed, a large amount of toner remains on the brush-shaped roller 17*a* of the lubricant applying unit 17. Therefore, the solid lubricant 17*b* is not sufficiently scraped. Further, the lubricant supplied onto the photosensitive member 5 is attached to the toner to be lost, thereby making the amount of supply of the lubricant onto the photosensitive member 5 uneven. With the toner also being added with a lubricant, such problems can be eliminated.

Next, a toner manufacturing scheme is described. Here, a preferable manufacturing scheme is described, but this is not meant to be restrictive.

(1) A colorant, polyester unmodified, polyester prepolymer having an isocyanate group, and a release agent are dispersed in an organic solvent to make a toner material liquid.

The organic solvent is preferably volatile with a boiling point of lower than 100° C. because it is easy to remove after forming toner main particles. Specifically, examples are toluene, xylene, benzene, carbon tetrachloride, methylene chloride, 1,2-dichloroethane, 1,1,2,-trichloroethane, trichloroethylene, chloroform, monochlorobenzene, dichloroethylidene, methyl acetate, ethyl acetate, methyl ethyl ketone, and methyl isobutyl ketone alone or in combination of two or more. Particularly preferable are an aromatic solvent, such as toluene and xylene; and halogenated hydrocarbon, such as methylene chloride, 1,2-dichloroethane, chloroform, and carbon tetrachloride. The organic solvent is normally used in an amount of 0 part-by-weight to 300 parts-by-weight, preferably 0 part-by-weight to 100 parts-by-weight, and more preferably 25 parts-by-weight to 70 parts-by-weight per 100 parts-by-weight of polyester prepolymer.

(2) The toner material liquid is emulsified in a water solvent under the presence of a surface-active agent and resin fine particles.

The water solvent may be water alone, or may include an organic solvent, such as alcohol (such as methanol, isopropyl alcohol, and ethylene glycol), dimethylformamide, tetrahydrofuran, cellosolves (such as cellosolvemethyl), and lower ketones (such as acetone and methyl ethyl ketone).

The water solvent is normally used in an amount of 50 parts-by-weight to 2000 parts-by-weight, and preferably 100 parts-by-weight to 1000 parts-by-weight per 100 parts-by-weight of the toner material liquid. If the amount is less than 50 parts-by-weight, the state of dispersion of the toner material liquid is unsatisfactory, and toner particles with a desired particle diameter cannot be obtained. The amount exceeding 20000 parts-by-weight is not economical.

Also, to make the state of dispersion in the water solvent satisfactory, a dispersant, such as a surface-active agent and resin fine particles, is added as appropriate.

Examples of the surface-active agent are an anionic surface-active agent, such as alkylbenzene sulfonate, c-olefin sulfonate, and phosphoric ester; a cationic surface-active agent of amine salt type, such as alkylamine salt, an amino alcohol fatty acid derivative, polyamine alcohol fatty acid derivative, and imidazoline, and of quaternary ammonium salt type, such as alkyltrimethyl ammonium salt, dialkyldimethyl ammonium salt, alkyldimethylbenzyl ammonium salt, pyridinium salt, alkylisoquinolinium salt, and benzethonium chloride; a nonionic surface-active agent, such as a fatty amide derivative and polyhydric alcohol; and an amphoteric surface-active agent, such as alanine, dodecyldi(aminoethyl) glycine, di(octylaminoethyl)glycine, and N-alkyl-N,N-dimethyl ammonium betaine.

Also, with the use of a surface-active agent having a fluoroalkyl group, only an extremely small amount of such an agent can achieve an effect. Examples of an anionic surface-active agent having a fluoroalkyl group are fluoroalkylcarboxylate with a carbon number of 2 to 10 and its metal salt, perfluoro octanesulfonyl disodium glutamate, 3-[ω-fluoroalkyl (C6 to C11) oxy]-1-alkyl (C3 to C4) sulfonic acid sodium, 3-[ω-fluoroalkanoyl (C6 to C8)-N-ethylamino]-1-propanesulfonic acid sodium, fluoroalkyl (C11 to C20) carbonxylate and its metal salt, perfluoroalkyl carbonxylate (C7 to C13) and its metal salt, perfluoroalkyl (C4 to C12) sulfonic acid sodium and its metal salt, perfluorooctane sulfonic acid diethanolamide, N-proplyl-N-(2-hydroxyethyl)perfluorooctansulfonamide, perfluoroalkyl (C6 to C10)sulfonamidepropyltrimethyl ammonium salt, perfluoroalkyl (C6 to C10)-N-ethylsulfonylglycin salt, and monoperfluoroalkyl (C6 to C16)ethylphosphoric ester.

Examples of trade names are Sarfron S-111, S-112, and S-113 (manufactured by Asahi Glass Co., Ltd.), Frorard FC-93, FC-95, FC-98, and FC-129 (manufactured by Sumitomo 3M Limited), Unidyne DS-101 and DS-102 (manufactured by Daikin Industries, Ltd), Megafac F-110, F-120, F-113, F-191, F-812, and F-833 (manufactured by Dainippon Ink and Chemicals, Inc.), "EFTOP" EF-102, 103, 104, 105, 112, 123A, 123B, 306A, 501, 201, and 204 (manufactured by Tohkem Products Co.), and Ftergent F-100 and F150 (manufactured by Neos Co.)

Also, examples of a cationic surface-active agent are primary or secondary aliphatic, or secondary amine acid with a fluoroalkyl group at right, aliphatic quaternary ammonium salt, such as perfluoroalkyl (C6-C10) sulfonamidepropyltrimethylammonium, pyridinium salt, and imidazolynium salt. Examples of brand names are Sarfron S-121 (manufactured by Asahi Glass Co., Ltd.), Frorard FC-135 (manufactured by Sumitomo 3M Limited), Unidyne DS-202 (manufactured by Daikin Industries, Ltd), Megafac F-150 and F824 (manufactured by Dainippon Ink and Chemicals, Inc.), "EFTOP" EF-132 (manufactured by Tohkem Products Co.), and Ftergent F-300 (manufactured by Neos Co.)

Resin fine particles are added so as to stabilize the toner main particles formed in the water solvent. To achieve this, resin fine particles are preferably added so that an applying ratio on the surface of a toner main particle is in a range of 10% to 90%. Examples are polymethyl methacrylate fine particles of 1 micrometer or 3 micrometers, polystyrene fine particles of 0.5 micrometer or 2 micrometers, and poly (styrene-acrylonitrile) fine particles of 1 micrometer. Examples of brand names are PB-200H (manufactured by Kao Co.), SGP (manufactured by Soukensha), Techpolymer SB (manufactured by Sekisui Plastics Co., Ltd), and SGP-3G (manufactured by Souken), and Micropearl (manufactured by Sekisui Fine Chemicals Division).

Also, inorganic compound dispersants can be used, such as tricalcium phosphate, calcium carbonate, titanium oxide, colloidal silica, and hydroxyapatite.

In combination with the resin fine particles and inorganic compound dispersants, dispersants with dispersed drops stabilized with high polymer protective colloid can be used. For example, (meta) acrylic monomer including acids, such as acrylic acid, methacrylic acid, α-cyanoacrylic acid, α-cyanomethacrylic acid, itacoic acid, crotonic acid, fumaric acid, maleic acid, or maleic anhydride, or a hydroxyl group, can be used. Examples of such (metha) acrylic monomer are acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic ester, diethylene glycol monomethacrylic ester, glyceric monoacrylic ester, glyceric monomethacrylic ester, N-methylol acrylic amide, and N-methylol methacrylic amide. Also, vinyl alcohol or ethers with or vinyl alcohol can be used. Examples of such ethers are vinyl methyl ether, vinyl ethyl ether, and vinyl propyl ether. Also, esters including a vinyl alcohol and a carboxyl group can be used. Examples of such esters are vinyl acetate, vinyl propionate, and vinyl butyrate. Furthermore, examples of dispersants are acrylamide, methacrylamide, diacetone acrylamide, and their methylol compounds; chloride acids, such as acrylic chloride and methacrylic chloride; nitrogen-containing compounds, such as vinylpyridine, vinylpyrrolidone, vinylimidazole, and ethyleneimine, and their heterocyclic homopolymer and copolymer; polyoxyethylenes, such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester; and celluloses, such as methyl cellulose, hydroxyethylcellulose, and hydroxypropylcellulose.

A dispersing scheme is not particularly restrictive. For example, known dispersing facilities of low-speed shearing type, high-speed shearing type, friction type, high-pressure jet type, and ultrasonic type can be applied. Of these, the high-speed shearing facility is preferable for obtaining a particle diameter of a dispersing element of 2 micrometers to 20 micrometers. When the high-speed shearing facility is used, the rotation speed is not particularly restrictive, but is normally at 1000 revolutions per minute to 30000 revolutions per minute, and preferably at 5000 revolutions per minute to 20000 revolutions per minute. A dispersing time is not particularly restrictive but, in a batch scheme, is normally 1 minute to 5 minutes. The temperature at the time of dispersion is normally 0° C. to 150° C. (under pressure), and preferably 40° C. to 98° C.

(3) When emulsified liquid is formed, amines (B) is simultaneously added for reaction with polyester prepolymer (A) having an isocyanate group.

This reaction accompanies either one or both of cross-linking reaction and elongating reaction of a molecular chain. A reaction time is selected depending on the structure of the isocyanate group included in the polyester prepolymer (A) and reactivity with amines (B), and is normally 10 minutes to 40 hours, and preferably 2 hours to 24 hours. A reaction temperature is normally 0° C. to 150° C., and preferably 40° C. to 98° C. Also, a known catalyst can be used as required. Specifically, dibutyltinlaurate and dioctyltinlaurate can be used.

(4) After the reaction is over, the organic solvent is removed from the emulsified dispersion (reactant). Then, cleaning and drying are performed to obtain toner main particles.

To remove the organic solvent, the entire system is gradually heated in a laminar mixing state. In a predetermined temperature range, the reactant is strongly mixed, and then the solvent is removed, thereby forming fusiform toner main particles. Also, when calcium phosphate, which is a substance dissolvable in acid or alkaline is used as a dispersion stabilizer, for example, calcium phosphate is dissolved in acid, such as hydrochloric acid, and then water cleaning is performed, for example to remove the calcium phosphate from the toner main particles. Other than that, removal can also be achieved through decomposition with enzyme.

(5) An electric charge control agent is implanted to the toner main particles obtained in the manner described above. Then, inorganic fine particles, such as silica fine particles or titanium oxide fine particles, are externally added, thereby obtaining a toner. Implantation of the electric charge control agent and external addition of the inorganic fine particles are preformed through a know scheme using a mixer or the like.

With this, a toner with a small particle diameter and a sharp particle diameter distribution can be easily obtained. Furthermore, with strong mixing in the process of removing the organic solvent, the particle shape can be controlled between a spherical shape and a rugby-ball shape. Furthermore, the morphology of the surface is also controlled between a smooth shape and a rough shape.

The toner manufactured by the above process is preferably used as single component magnetic toner or non-magnetic toner.

The two components developer as shown in the illustrative embodiments is used with a magnetic carrier. The magnetic carrier is preferably from 20 to 100 μm in the average particle diameter and is a ferrite carrier including Mn2+, Cu2+, Zn2+, and the like. In the case that the average particle diameter is less than 20 μm, the magnetic carrier bears on photoconductive drum 1. And in the case that the average particle diameter is over 100 μm, no charging may result since it is not mixed with toner. It is preferable to use a ferrite carrier including Cu with Zn. A resin coating with magnetic carrier is used a silicon resin, a styrene-acrylic resin, a fluorine resin, olefin resin and so on, but however is not limited by that. A thickness of the resin is from 0.05 to 10 μm, preferably from 0.3 to 4 μm.

Obviously, numerous modifications and variations of the present invention are possible in light of the above teachings. It is therefore to be understood that within the scope of the appended claims, the present invention may be practiced otherwise than as specifically described herein.

The invention claimed is:

1. An image forming apparatus comprising:

an image carrier;

a charging device configured to uniformly charge a surface of said image carrier with a charging member, which is applied with a bias of a first polarity for charging;

a latent image forming device configured to form a latent image on the surface of said image carrier uniformly charged;

a developing device configured to develop the latent image by depositing toner grains of the first polarity on said latent image to thereby form a corresponding toner image;

a transferring device configured to form an electric field between said image carrier and a moving member whose surface is movable in contact with said image carrier to thereby transfer the toner image from the surface of said image carrier to said moving member or a recording member nipped between said image carrier and said moving member;

a polarity controlling device configured to set residual toner to a second polarity opposite to said first polarity, before the residual toner left on said image carrier by the transferring device is conveyed to a corresponding position to said charging member; and an electric charging device configured to keep the residual toner at a keeping area formed between the charging member and a bias applying blade adjacent the charging member, and configured to charge the residual toner deposited on said charging member to said first polarity; wherein said charging device discharges the residual toner whose polarity is charged to said first polarity onto said image carrier at a predetermined time.

2. The apparatus as claimed in claim 1, wherein said developing device generates a first electric field between a developer bearing member of said developing device and said latent image forming device, to move toner grains deposited on said developer bearing member to said latent image forming device, and generates a second electric field opposite in polarity to said first electric field, from which the residual toner deposited on said image carrier reaches a developing area developed by said developing device, to which the residual toner passes through said developing area.

3. The apparatus as claimed in claim 1, wherein said polarity controlling device includes a moving element moving and contacting the surface of said image carrier, and a driving device driving said moving element in a same linear direction as said image carrier, and the second power source applies a DC bias of said second polarity.

4. The apparatus as claimed in claim 3, wherein said second power source applies an AC-biased DC bias.

5. The apparatus as claimed in claim 3, wherein said driving device drives said moving element to move with a linear velocity from 1.01 to 2.5 times faster than of said image carrier, at a position where said moving element contacts said image carrier.

6. The apparatus as claimed in claim 4, wherein said second power source applies said AC-biased DC bias with a frequency from 500 Hz to 10,000 Hz.

7. The apparatus as claimed in claim 1, wherein said charging device faces said image carrier with a gap between a surface of said charging member and the surface of said image carrier.

8. The apparatus as claimed in claim 1, wherein said toner has a volume-mean grain size of 3 micrometers to 8 micrometers and a ratio of a volume-mean grain size and number-mean grain size of 1.00 to 1.40.

9. The apparatus as claimed in claim 1, wherein said toner has a ratio of roundness of toner shape SF-1 from 100 to 180 and a ratio of toner shape SF-2 from 100 to 180.

10. The apparatus as claimed in claim 1, wherein a particle of the toner is an approximately spherical shape defined by a major axis r1, a minor axis r2, and a thickness r3, where r1>=r2>=r3, a ratio of the minor axis r2 to the major axis r1 is in a range of 0.5 to 1.0, and a ratio of the thickness r3 is the minor axis r2 in a range of 0.7 to 1.0.

11. The apparatus as claimed in claim 1, further comprising:

a process cartridge collectably mounting said image carrier and at least one of said charging device and said developing device, wherein said process cartridge is detachably mounted on said apparatus.

12. A process cartridge detachably mounted on an image forming apparatus, comprising:

an image carrier;

a polarity controlling device configured to set residual toner to a second polarity opposite to a first polarity, before the residual toner left on said image carrier by a transferring is conveyed to a corresponding position to a charging member; and at least one of a charging device configured to keep the residual toner at a keeping area formed between the charging member and a bias applying blade adjacent the charging member, and to uniformly charge a surface of said image carrier with a charging member, which is applied with a bias of the first polarity for charging, and a developing device configured to develop the latent image by depositing toner grains of the first polarity for charging a latent image to thereby form a corresponding toner image.

13. A method for forming an image, comprising:

charging a surface of an image carrier with a charging member, which is applied with a bias of a first polarity for charging;

forming a latent image of the surface of said image carrier uniformly charged;

developing the latent image by depositing toner grains of the first polarity on said latent image to thereby form a corresponding toner image;

forming an electric field between said image carrier and a moving member whose surface is movable in contact with said image carrier to thereby transfer the toner image from the surface of said image carrier to said moving member or a recording member nipped between said image carrier and said moving member; and charging residual toner to a second polarity opposite to said first polarity, before the residual toner left on said image carrier by a transferring is conveyed to a corresponding position to said charging member, keeping the residual toner at a keeping area formed between the charging member and a bias applying blade adjacent the charging member, and charging the residual toner deposited on said charging member to said first polarity; and discharging the residual toner whose polarity is charged to the first polarity, on said image carrier at a predetermined time.

14. An image forming apparatus, comprising:

an image carrier;

means for uniformly charging a surface of said image carrier with a bias of a first polarity for charging;

means for forming a latent image on the surface of said image carrier uniformly charged;

means for developing the latent image by depositing toner grains of the first polarity on said latent image to thereby form a corresponding toner image;

means for forming an electric field between said image carrier and a moving member whose surface is movable in contact with said image carrier to thereby transfer the toner image from the surface of said image carrier to said moving member or a recording member nipped between said image carrier and said moving member; and means for charging residual toner to a second polarity opposite to said first polarity, before the residual toner left on said image carrier by a transferring is conveyed to a corresponding position to said means for charging, means for keeping the residual toner at a keeping area formed between the means for charging and a bias applying blade adjacent the means for charging, and for charging the residual toner deposited on said charging member to said first polarity; wherein said means for uniformly charging discharges the residual toner whose polarity is charged to said first polarity on said image carrier at a predetermined time.

* * * * *